US009586724B2

(12) United States Patent
Moehlenbrock et al.

(10) Patent No.: US 9,586,724 B2
(45) **Date of Patent: *Mar. 7, 2017**

(54) EASY OPEN AND RECLOSABLE GUSSETED PACKAGE WITH DIE-CUT WEB AND RECLOSURE MECHANISM

(71) Applicant: Cryovac, Inc., Duncan, SC (US)

(72) Inventors: Andrew W. Moehlenbrock, Simpsonville, SC (US); Hubert J. Cook, Simpsonville, SC (US)

(73) Assignee: Cryovac, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/300,292

(22) Filed: Jun. 10, 2014

(65) Prior Publication Data

US 2015/0353238 A1 Dec. 10, 2015

(51) Int. Cl.
*B65D 30/20* (2006.01)
*B65D 33/25* (2006.01)

(52) U.S. Cl.
CPC ..... *B65D 31/10* (2013.01); *B65D 33/25* (2013.01); *B65D 33/2575* (2013.01); *B65D 33/2583* (2013.01); *B65D 2313/02* (2013.01)

(58) Field of Classification Search
CPC ..... B65D 33/20; B65D 31/10; B65D 33/25; B65D 33/2575; B65D 33/2583; B65D 2313/02; B31B 19/90; B65B 61/188; B65B 9/20; B65B 9/213
USPC ..... 383/61.2, 63, 200, 203, 204, 207, 383/209–211
See application file for complete search history.

(56) References Cited

U.S. PATENT DOCUMENTS 2,719,663 A * 10/1955 Meyer-Jagenberg .. B65D 5/708 229/123.3
3,595,468 A * 7/1971 Repko ..... B65D 75/68 206/0.84
3,613,874 A * 10/1971 Miller ..... B65D 77/12 206/459.5

(Continued)

FOREIGN PATENT DOCUMENTS

EP 1468931 A1 10/2004
EP 1304213 B1 5/2006
WO 2011001223 A1 1/2011

OTHER PUBLICATIONS

Aplix Packaging, Oct. 11, 2011, 3 pages.

*Primary Examiner* — Peter Helvey

(57) ABSTRACT

An easy-open/reclosable gusseted package includes a reclosure mechanism including a first and second interlocking strip; a die cut in a first panel and in a first and optionally a second gusset. The die cut defines a die cut segment spaced from the first and second ends of the package that can be displaced to open the package and access a contained product between the interlocking strips, the interlocking surfaces being at least partially exposed. The package can be reclosed, after removing the die cut segment, by engaging the interlocking surface of a second portion of the first interlocking strip with itself in the first gusset, and optionally a third portion of the first interlocking strip with itself in the second gusset, folding the package, and engaging the interlocking surface of the second interlocking strip with the interlocking surface of the first portion of the first interlocking strip.

21 Claims, 24 Drawing Sheets

(56) References Cited

U.S. PATENT DOCUMENTS 3,655,118 A * 4/1972 Rinecker ..... A44B 18/00 383/62
3,942,713 A * 3/1976 Olson ..... B65D 33/20 206/260
4,156,493 A * 5/1979 Julius ..... B65D 83/0805 206/494
4,318,506 A * 3/1982 Hirsch ..... B65D 75/30 206/438
4,335,817 A * 6/1982 Bahr ..... B65D 33/25 206/260
4,709,399 A * 11/1987 Sanders ..... B65D 33/1691 206/813
4,785,940 A * 11/1988 Wilson ..... B65D 33/20 383/204
4,786,190 A * 11/1988 Van Erden ..... B65D 75/20 206/260
4,902,142 A * 2/1990 Lammert ..... B65D 33/20 383/205
4,946,038 A * 8/1990 Eaton ..... B65D 77/206 206/528
4,946,289 A * 8/1990 Bolling ..... B65D 33/24 383/204
5,044,772 A * 9/1991 Larson ..... B65D 33/1691 229/80
5,044,776 A 9/1991 Schramer et al.
5,167,455 A 12/1992 Forman
5,205,649 A 4/1993 Fullerton
5,346,301 A 9/1994 Scarberry et al.
5,391,136 A 2/1995 Makowka
5,461,845 A 10/1995 Yeager
5,476,323 A 12/1995 Gold
5,564,834 A 10/1996 Porchia
5,658,077 A 8/1997 Hoftman
5,806,984 A 9/1998 Yeager
5,836,697 A 11/1998 Chiesa
5,855,435 A 1/1999 Chiesa
5,882,749 A 3/1999 Jones et al.
5,882,789 A 3/1999 Jones et al.
5,954,433 A 9/1999 Yeager
6,012,844 A 1/2000 Huseman et al.
6,048,100 A 4/2000 Thrall et al.
6,056,141 A 5/2000 Navarini et al.
6,106,153 A 8/2000 Toshima
6,196,716 B1 3/2001 Geyer
D447,054 S 8/2001 Hill
6,461,044 B1 10/2002 Anderson
6,502,986 B1 1/2003 Bensur et al.
6,589,622 B1 7/2003 Scott
6,662,843 B1 12/2003 Johnson
6,793,077 B1 9/2004 Kancsar et al.
6,805,485 B2 10/2004 Hogan et al.
6,865,860 B2 3/2005 Arakawa et al.
6,925,779 B2 8/2005 Thieman
6,991,375 B2 1/2006 Clune et al.
7,033,077 B2 4/2006 Taylor
7,041,042 B2 5/2006 Chertkow et al.
7,073,309 B2 7/2006 van Driesten
7,216,764 B2 5/2007 Forman
7,217,033 B2 5/2007 Pritchard
7,305,805 B2 12/2007 Dierl et al.
7,314,312 B2 1/2008 Soderholm
7,322,473 B2 1/2008 Fux
7,395,642 B2 7/2008 Plourde et al.
7,422,782 B2 9/2008 Haedt et al.
7,527,839 B2 5/2009 Busche et al.
D597,857 S 8/2009 Lin
7,681,732 B2 3/2010 Moehlenbrock et al.
8,690,046 B2 4/2014 Plourde
8,727,621 B2 5/2014 Owensby et al.
9,156,224 B2 * 10/2015 Pease ..... B31B 19/90
2004/0001927 A1 1/2004 Moran et al.
2004/0013322 A1 1/2004 Taylor
2005/0025395 A1 2/2005 Howell et al.
2006/0062496 A1 3/2006 Clune et al.
2006/0083446 A1 4/2006 Sampaio Camacho
2006/0093765 A1 5/2006 Mueller
2006/0141196 A1 6/2006 Utz
2006/0246184 A1 11/2006 Rietjens et al.
2006/0251341 A1 11/2006 Sampaio Camacho
2006/0251342 A1 11/2006 Forman
2006/0257611 A1 11/2006 Chiesa
2007/0104395 A1 5/2007 Kinigakis et al.
2007/0104398 A1 5/2007 Ours
2007/0114144 A1 5/2007 Suzuki et al.
2007/0140599 A1 6/2007 Dalgleish et al.
2007/0141287 A1 6/2007 Laaksonen et al.
2008/0041022 A1 2/2008 Shepard et al.
2008/0056622 A1 3/2008 Austreng et al.
2008/0131035 A1 6/2008 Rogers
2008/0260305 A1 10/2008 Shah et al.
2009/0053372 A1 2/2009 Hambrick et al.
2009/0127281 A1 5/2009 Hickey
2009/0148081 A1 6/2009 Rogers
2009/0152139 A1 * 6/2009 Roesink ..... A24F 23/02 206/260
2009/6015213 6/2009 Roesink et al.
2009/0202183 A1 8/2009 Hagino
2009/0226117 A1 9/2009 Davis et al.
2009/0257686 A1 10/2009 Anzini
2009/0279813 A1 11/2009 Pokusa et al.
2009/0304874 A1 12/2009 Stephens et al.
2009/0311454 A1 12/2009 Stephens
2010/0111453 A1 5/2010 Dierl
2010/0113239 A1 5/2010 Peterson
2010/0209551 A1 8/2010 Mitra-Shah et al.
2010/0278454 A1 11/2010 Huffer
2010/0290719 A1 11/2010 Yeager
2010/0327046 A1 12/2010 Mohda et al.
2011/0036741 A1 2/2011 Moehlenbrock
2011/0038569 A1 2/2011 Huffer et al.
2011/0038570 A1 2/2011 Moehlenbrock et al.
2011/0038571 A1 2/2011 Moehlenbrock
2011/0038572 A1 2/2011 Moehlenbrock
2011/0038573 A1 2/2011 Moehlenbrock
2011/0097019 A1 4/2011 Moehlenbrock et al.
2011/0097022 A1 4/2011 Moehlenbrock
2011/0097023 A1 4/2011 Moehlenbrock
2011/0097024 A1 4/2011 Moehlenbrock et al.
2011/0249919 A1 10/2011 Shepard
2012/0006822 A1 1/2012 Yeager
2012/0052161 A1 3/2012 Woodham
2012/0187125 A1 7/2012 Plourde
2012/0195526 A1 8/2012 Moehlenbrock et al.
2012/0195527 A1 8/2012 Moehlenbrock et al.
2012/0195531 A1 8/2012 Moehlenbrock et al.
2012/0202667 A1 8/2012 Greco et al.
2012/0207408 A1 8/2012 Moehlenbrock et al.
2012/0207410 A1 8/2012 Moehlenbrock
2012/0207412 A1 8/2012 Moehlenbrock et al.
2012/0224795 A1 9/2012 Moehlenbrock
2013/0316887 A1 11/2013 Yeager

* cited by examiner

EASY OPEN AND RECLOSABLE GUSSETED PACKAGE WITH DIE-CUT WEB AND RECLOSURE MECHANISM

FIELD OF THE INVENTION

This invention relates to an easy-open and reclosable gusseted package with a die-cut web and a reclosure mechanism, and to methods of making the package.

BACKGROUND OF THE INVENTION

Food and non-food products have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes vertical form/fill/seal (VFFS) and continuous horizontal packaging (sometimes referred to as Flow-wrap). In each case, the product is manually or automatically placed in a pouch, bag, or formed web, the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of pressure sensitive adhesive (PSA) to provide a reclosability feature to a package. However, based on the position of the adhesive relative to the package, the adhesive can sometimes be contaminated by the contained product before the package is opened, or once the package is opened, when product is removed from the package and comes in contact with the adhesive. This phenomenon can compromise the reclosability of the package. Also, the performance of the adhesive can sometimes be compromised at refrigerated conditions, or in the presence of grease or moisture caused by the packaging of greasy or wet foods.

Also common in the industry is the use of plastic zipper closures; press-to-close or slide zippers, interlocking closures; reclosable fasteners with interlockable fastener elements; and interlocking rib and groove elements having male and female profiles; interlocking alternating hook-shaped closure members, and hook and loop fasteners; fasteners employing self-engageable male fastener elements; fasteners utilizing interference fit, and the like. These features provide reclosability, and in some cases may provide an easy-open feature to the package.

There is need in the marketplace for a package, and methods of packaging involving e.g. a VFFS or continuous horizontal packaging process, that can be used in a manner that requires little or no modification to the packager's packaging equipment; provides a manually (i.e. by hand, without the need for tools such as scissors or knives) openable and easy to reclose feature, optionally while maintaining hermeticity of the package when made, and optionally without the use of PSA; provides a relatively large opening for accessing the product when the easy-open feature is activated; and can be opened and closed a number of times, and adapted to package food and non-food products.

SUMMARY OF THE INVENTION

In a first aspect, an easy-open and reclosable gusseted package, enclosing a product, comprises a pouch comprising a) a first and second side panel each comprising an outer and inner surface, a first and second side edge, and a first and second end;
b) a first pouch end and a second pouch end;
c) a first and second gusset each comprising an outer and inner surface, a first and second side edge, and a first and second end, the first gusset connecting the first and second side panels at a first side of the pouch, and the second gusset connecting the first and second side panels at a second side of the pouch;
d) a reclosure mechanism comprising
   (i) a first interlocking strip comprising
      (a) a first and second side edge,
      (b) a first and second end, and
      (c) an interlocking segment having a base surface and an interlocking surface,
   wherein a first portion of the first interlocking strip is anchored to the inner surface of the first side panel such that a part of the interlocking surface faces the inner surface of the first side panel, and a second portion of the first interlocking strip is anchored to the inner surface of the first gusset, and
   (ii) a second interlocking strip comprising a first and second side edge, a first and second end, and an interlocking segment having a base surface and an interlocking surface, the second interlocking strip anchored to the inner surface of at least one of the first and second side panels, such that the interlocking surface faces the inner surface of the first side panel; and
e) a die cut disposed in the first side panel and the first gusset, the die cut defining a die cut segment that is spaced from the first and second ends of the package.

In a second aspect, a method of making an easy-open and reclosable gusseted package in a vertical form/fill/seal process comprises:

a) providing a lay-flat web, the lay-flat web comprising a first and second surface, and a die cut;
b) providing a reclosure mechanism comprising a first and second interlocking strip each comprising a first and second side edge, a first and second end, and an interlocking segment having a base surface and an interlocking surface;
c) advancing the lay-flat web with the reclosure mechanism over a forming device to convert the lay-flat web to a folded web having an interior surface;
d) longitudinally sealing the folded web to make a longitudinal seal;
e) forming a first and second gusset in the folded web;
f) transversely sealing the folded web to produce a first transverse seal to define a first pouch, wherein the first transverse seal is a bottom transverse seal of the first pouch;
g) putting a product in the first pouch;
h) advancing the folded web, with the first pouch, downward a predetermined distance;
i) transversely sealing the first pouch to produce a top transverse seal in the first pouch, and a bottom transverse seal in a second pouch, the second pouch disposed above the first pouch; and
j) transversely cutting the folded web to separate the first pouch from the second pouch to make a package, the package comprising
   (i) a first and second side panel each comprising an outer and inner surface, a first and second side edge, and a first and second end,
   (ii) a first pouch end and a second pouch end, (iii) the first and second gusset each comprising an outer and inner surface, a first and second side edge, and a first and second end, the first gusset connecting the first and second side panels at a first side of the pouch, and the second gusset connecting the first and second side panels at a second side of the pouch, and (iv) a first portion of the first interlocking strip anchored to the inner surface of the first side panel such that a part of the interlocking surface of the first interlocking strip faces the inner surface of the first side panel, and a second portion of the first interlocking strip anchored to the inner surface of the first gusset, and the second interlocking strip anchored to the inner surface of at least one of the first and second side panels such that the interlocking surface faces the inner surface of the first side panel;

wherein each of the first and second interlocking strips is either pre-anchored to the lay-flat web, or is anchored to the lay-flat web or folded web at any time before or during the step of making the longitudinal seal in the folded web; and wherein the die cut is disposed in the first side panel and the first gusset, the die cut defining a die cut segment that is spaced from the first and second ends of the package.

In a third aspect, a method of making an easy-open and reclosable gusseted package in a continuous horizontal packaging process comprises:

a) providing a lay-flat web, the lay-flat web comprising a first and second surface, and a die cut;

b) providing a reclosure mechanism comprising a first and second interlocking strip each comprising a first and second side edge, a first and second end, and an interlocking segment having a base surface and an interlocking surface;

c) advancing the lay-flat web with the reclosure mechanism to a forming device to convert the lay-flat web into a folded web having an interior surface;

d) advancing a product to the forming device such that the folded web envelopes the product;

e) longitudinally sealing the folded web to make a longitudinal seal;

f) forming a first and second gusset in the folded web;

g) transversely sealing the folded web, with the product therein, to produce a leading transverse seal to define a first pouch;

h) advancing the folded web, with the leading transverse seal, forward a predetermined distance;

i) transversely sealing the folded web to produce a trailing transverse seal in the first pouch, and a leading transverse seal in a second pouch, the second pouch disposed upstream of the first pouch; and j) cutting the folded web to separate the first pouch from the second pouch to form an individual package comprising (i) a first and second side panel each comprising an outer and inner surface, a first and second side edge, and a first and second end, (ii) a first pouch end and a second pouch end, (iii) the first and second gusset each comprising an outer and inner surface, a first and second side edge, and a first and second end, the first gusset connecting the first and second side panels at a first side of the pouch, and the second gusset connecting the first and second side panels at a second side of the pouch, and (iv) a first portion of the first interlocking strip anchored to the inner surface of the first side panel such that a part of the interlocking surface of the first interlocking strip faces the inner surface of the first side panel, and a second portion of the first interlocking strip anchored to the inner surface of the first gusset, and the second interlocking strip anchored to the inner surface of at least one of the first and second side panels such that the interlocking surface of the second interlocking strip faces the inner surface of the first side panel;

wherein each of the first and second interlocking strips is either pre-anchored to the lay-flat web, or is anchored to the lay-flat web or folded web at any time before or during the step of making the longitudinal seal in the folded web; and wherein the die cut is disposed in the first side panel and the first gusset, the die cut defining a die cut segment that is spaced from the first and second ends of the package.

BRIEF DESCRIPTION OF THE DRAWINGS

The present invention is illustrated by reference to the following drawing figures, encompassing different views of various embodiments of the invention, wherein.

DEFINITIONS

Figure 1:
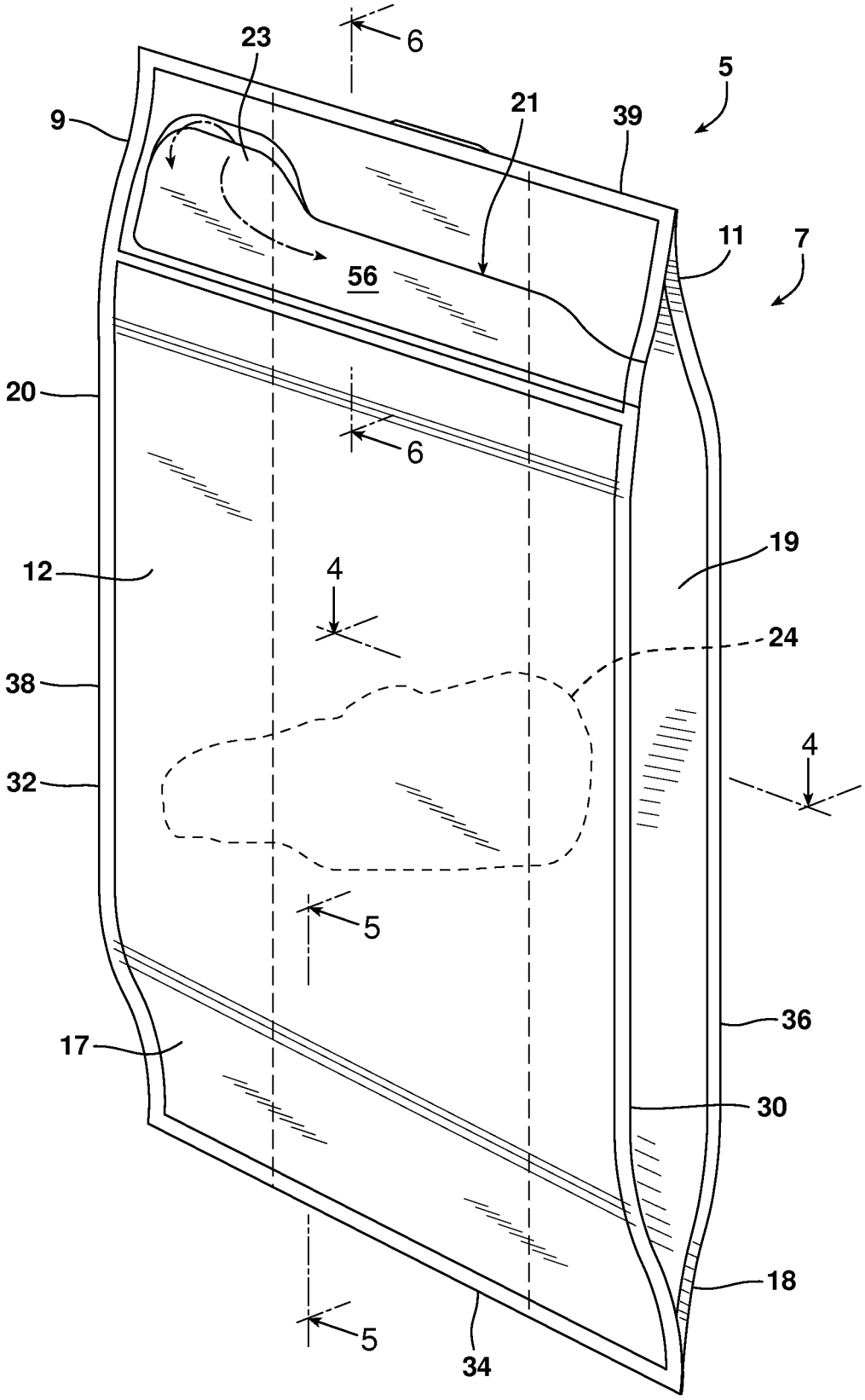
FIG. 1 is a perspective view of a package.

"Anchored", "anchoring" and the like herein refers to sealing or adhering two surfaces together, and refers to the resulting bond between surfaces. Sealing is done by means of a sealant. Adhering is done by means of adhesive. In processes described herein where a strip is anchored to a web or side panel, either during a process wherein the web and strip are advanced, or when a strip has been pre-anchored to the web before the start of the process, anchoring can be done by use of any suitable continuous or discontinuous sealing or adhesive material and method. Such anchoring is done to hold the strip to the web during the relevant packaging process, and to the final package. In some embodiments, wherein the anchor is already relatively strong or continuous, e.g. a heat seal that constitutes either a relatively strong heat seal, or an easy-open seal as defined herein, the anchor functions not only to hold a strip to a web during a packaging process, but also as a final seal of that surface of the strip to the web (lay-flat or folded) or panel made from the web. Any subsequent step in the process of sealing one of the surfaces (i.e. the anchored surface) of the strip to a web or panel, is in these embodiments already completed by the anchoring step, and contact of a seal device, e.g. a seal bar in the region of the anchor, in a subsequent step, may add no further or separate seal to that surface of the strip. In some embodiments where the bond is a relatively weak or discontinuous one, e.g. a discontinuous seal, spots or narrow stripes of adhesive, etc., in a subsequent step of sealing one of the surfaces of the strip to the web or panel, a seal bar that seals one of the surfaces of the strip to the web or panel can contact the web or panel in the region where the anchor is already disposed. The seal in that region may be either enhanced, or initially created, by the subsequent sealing step. Anchoring a strip to a surface, as described herein, should be understood as anchoring all, or at least a portion of, the strip to all, or at least a portion of, the surface.

"Closed-loop" herein refers to a die cut that defines a closed pattern or path in the first side panel and gusset(s) whereby the web material within the path (the closed loop die-cut segment) can be partially or totally removed.

"Die cut" and the like herein refers to methods of cutting or scoring materials, including rotary die, steel rule die, platen die cutting, and laser cutting or scoring; and to the resulting cut or score. A die cut can extend entirely or partially through the relevant layer or web, and can in some embodiments leave intact a certain amount of material. "Score" and the like herein refers to a partial die cut that extends partly but not entirely through the thickness of a material, layer, web, panel, etc. The purpose of the score in the present invention is to provide for controlled tear or separation of material in the act of displacing the die cut segment, while maintaining the integrity of the package before it is initially opened. The depth of the cut can vary from package to package, and within a single die cut or die cut segment on a given package.

"Die-cut segment" herein refers to a portion of the first side panel and first and/or second gusset that can be displaced because of the presence of a closed-loop or open-loop die cut. The die-cut segment is a piece of the first side panel and first and/or second gusset, and when displaced can in some embodiments function as a tamper evidence device, and facilitates access to the interior of the package.

"Displaced" and the like herein refers e.g. to a die cut segment that has been at least partially moved from its original position, and in some embodiments entirely removed from the package, sufficient to open the package and provide access to its contents.

"Easy-open" herein refers to a package that can be manually opened relatively easily.

"Easy-open seal" herein refers to a seal involving two surfaces, in which materials and sealing conditions are chosen such that the package is easy-open with a physical mode of opening that includes any one or more of adhesive failure, delamination failure, or cohesive failure.

"Easy-open sealant" herein refers to a material chosen for one or both surfaces of an interlocking strip and web, such that when such surfaces are sealed to each other, the resulting package is easy-open with a physical mode of opening that includes any one or more of adhesive failure, delamination failure, or cohesive failure.

"Engage" and the like with respect to interlocking surfaces herein means that some or all of the interlocking surface of one interlocking strip attaches to some or all of the interlocking surface of another interlocking strip.

"Exposed" herein means exposed to the exterior environment outside the package.

"Fig." herein refers to drawing figure; "Figs." to drawing figures.

"Film" is used herein to mean a thermoplastic film, laminate, or web, either multilayer or monolayer, that may be used in connection with the present invention. Film can be of any suitable thickness, e.g. between 0.1 and 30 mils.

"Interlocking strip" and the like is used herein to refer to a strip of material having an interlocking surface that can be mechanically engaged with (interlocked with) another interlocking strip, of the same or different construction, to provide a package that can be opened and reclosed a number of times. Examples of an interlocking strip include, without limitation, 1) zippers such as those associated with the ZIPLOC™ and ZIP-PAK trademarks, and disclosed in e.g. US2003/0103687 A1 (Schneider et al.), but excluding a slide zipper; 2) interlocking alternating hook-shaped closure members, and hook and loop fasteners such as those associated with the VELCRO™ trademark, and disclosed in e.g. US2006/0062496 A1 (Clune et al.); 3) fasteners employing self-engageable fastener elements such as those associated with the APLIX™ trademark, and disclosed in e.g. US 2010/0135600 A1 (Ducauchuis et al.) and U.S. Pat. No. 7,841,052 B2 (Ducauchuis), and those associated with the VECTOR™ trademark, see e.g. U.S. Pat. No. 8,690,046 (Plourde); and 4) fasteners utilizing interference fit, e.g. as shown in U.S. Pat. No. 3,727,829 (Huni); all these US patent publications and patents incorporated by reference in their entirety. An "interlocking surface" herein will typically be three-dimensional. It will be understood that in some embodiments of the invention, only a portion of the interlocking surface of each of the respective interlocking strips may be exposed when the die cut segment is displaced.

Likewise, in some embodiments of the invention, when the package is reclosed, only a portion of the exposed respective interlocking surfaces may be interlocked with one another.

"Longitudinal seal" herein refers to a fin seal or lap seal.

"Olefinic" and the like herein refers to a polymer or copolymer derived at least in part from an olefinic monomer.

"Open-loop" herein refers to a die cut that defines an open pattern or path in the first side panel and gusset(s) whereby the web material within the path or pattern (the die-cut segment) can be displaced from its original position on the panel.

"Polymer" and the like herein means a homopolymer, but also a copolymer thereof, including terpolymer, tetrapolymer, block copolymer, etc.

"Pouch" herein means a pouch or bag.

"Pre-anchored" herein means an embodiment wherein an interlocking strip has been anchored to a web before the start of the relevant process. For example, an interlocking strip can be anchored to a lay-flat web by a supplier of the web, and the rolled up web, with the interlocking strip anchored thereto, can then be supplied to a packager who uses the web and strip in any of the processes disclosed herein.

"Reclosable" herein refers to a feature or function of a package whereby a package can be reclosed by folding the package such that a first interlocking strip is brought into interlocking engagement with a second interlocking strip.

"Reclosure mechanism" herein refers to a first and second interlocking strip, each strip including a first and second side edge, a first and second end, and an interlocking segment having a base surface and an interlocking surface.

"Registration device" herein refers to any mark, pattern, die cut or feature of a web or interlocking strip, that facilitates the advancement of the web or strip, in a controlled manner, into a packaging machine, where the web or strip is used to make individual packages. These marks are used in connection with appropriate sensors to controllably advance the web or strip.

"Seal" herein means a bond between two thermoplastic surfaces, e.g. as produced by heat sealing, radio frequency (RF) sealing, ultrasonic sealing, adhesive, etc., or a combination of any of these modes of sealing. Sealing a strip to a surface, as described herein, should be understood as sealing all, or at least a portion of, the strip to all, or at least a portion of, the surface.

"Sealant" is a polymeric material or blend of materials, such as olefinic polymer or copolymer such as an ethylenic polymer or copolymer, that can form a surface of an interlocking strip, and/or a web to which the strip is sealed, and form a bond between two thermoplastic surfaces. A permanent or a repositionable adhesive such as pressure sensitive adhesive can also be a sealant.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Web" is used herein to mean a thermoplastic film, laminate, or web, either multilayer or monolayer, that may be used in connection with the present invention. The web can be of any suitable thickness, e.g. between 0.1 and 30 mils, and the web can be of any suitable length and width.

"Zipper" and the like herein refers to a plastic zipper closure or press-to-close zipper, interlocking closure, reclosable fastener with interlockable fastener elements, interlocking rib and groove elements having male and female profiles, interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

Referring to the drawings, a package 5 according to the invention is shown. Package 5 includes a pouch 7 that can be made from a lay-flat web or webs comprising a thermoplastic material of any suitable composition, e.g. those disclosed in U.S. Pat. No. 8,727,621 B2 (Owensby et al.), the contents of which are incorporated herein by reference in their entirety. Examples are those webs having as at least one component olefinic materials such as ethylene or propylene polymers or copolymers, e.g. polyethylene or ethylene/alpha olefin copolymers; or polyethylene terephthalate (PET). The web can be monolayer or multilayer in construction, and can be coextruded, laminated, or made by any suitable film making process.

First and second side panels 12 and 14 are joined together along their respective first and second side edges by first and second gussets 19 and 20 respectively. Gussets 19 and 20 can be formed in any conventional manner, e.g. from a segment of lay-flat web integral with other segments of the lay-flat web that will form the front and rear panels.

Optionally, rib seals can be formed on a first and second side of the pouch, so that rib seal 30 defines the connection of the first gusset 19 to first panel 12, rib seal 36 defines the connection of the first gusset 19 to second panel 14, rib seal 32 defines the connection of the second gusset 20 to first panel 12, and rib seal 38 defines the connection of the second gusset 20 to second panel 14.

The upper part of the package includes upper front portion 9, upper rear portion 11, and first end 39 that can be a heat seal or fold that includes the first end 15 of first side panel 12, and the first end 16 of second side panel 14. The lower part of the package includes lower front portion 17, lower rear portion 18, and second end 34 that can be a heat seal or fold.

Figure 18:
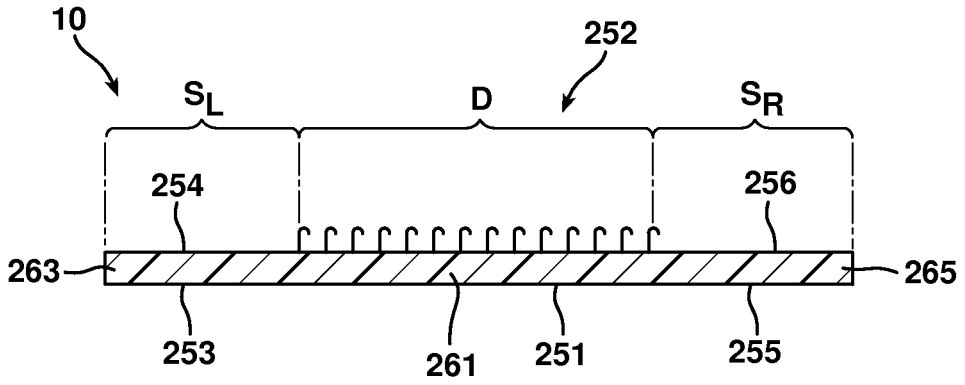
FIG. 18 is a schematic view of an interlocking strip.

Package 5 also includes first and second interlocking strips 10 and 13 respectively. Referring to FIG. 18, strips 10 and 13 include an interlocking segment "D" of the strip, having a base portion 261, a base surface 251 and interlocking surface 252. Surface 252 can comprise e.g. a field of hook-shaped features that can be engaged with a complementary field of loop-shaped features disposed on a second interlocking strip, or vice versa. Alternatively, a set of mushroom or T-shaped features, such as disclosed in US 2010/0135600 A1, or self-mating features, or more broadly, any suitable interlocking mechanism can be employed. Surface 252 of interlocking segment "D" is attached, imbedded in, or otherwise connected to base surface 251, or alternatively included as an integral component, e.g. a molded or extruded component, of interlocking segment "D" or of strip 10.

Figure 10:
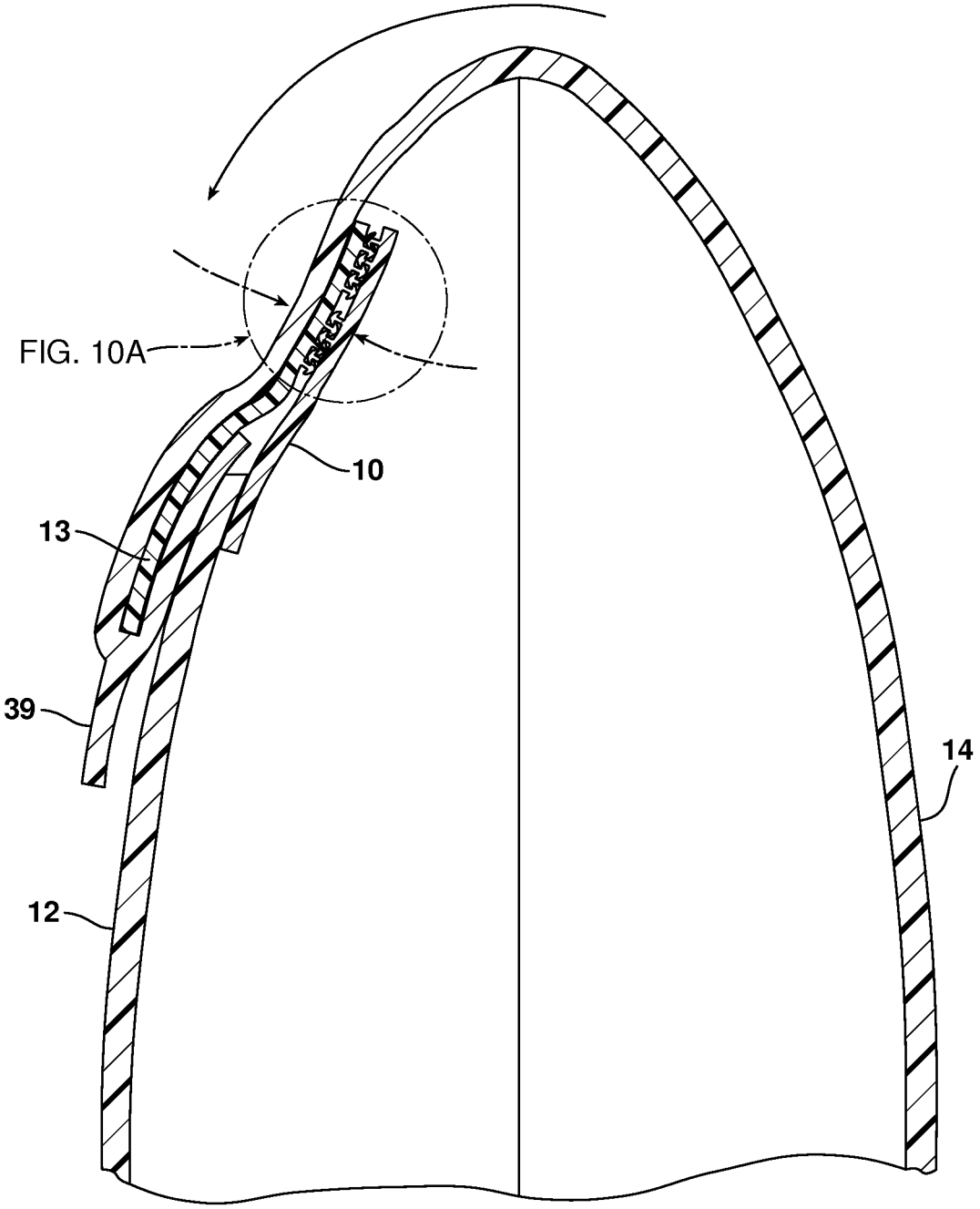
FIG. 10 is a cross-sectional view of a portion of the package of FIG. 8A after it has been reclosed.
Figure 10A:
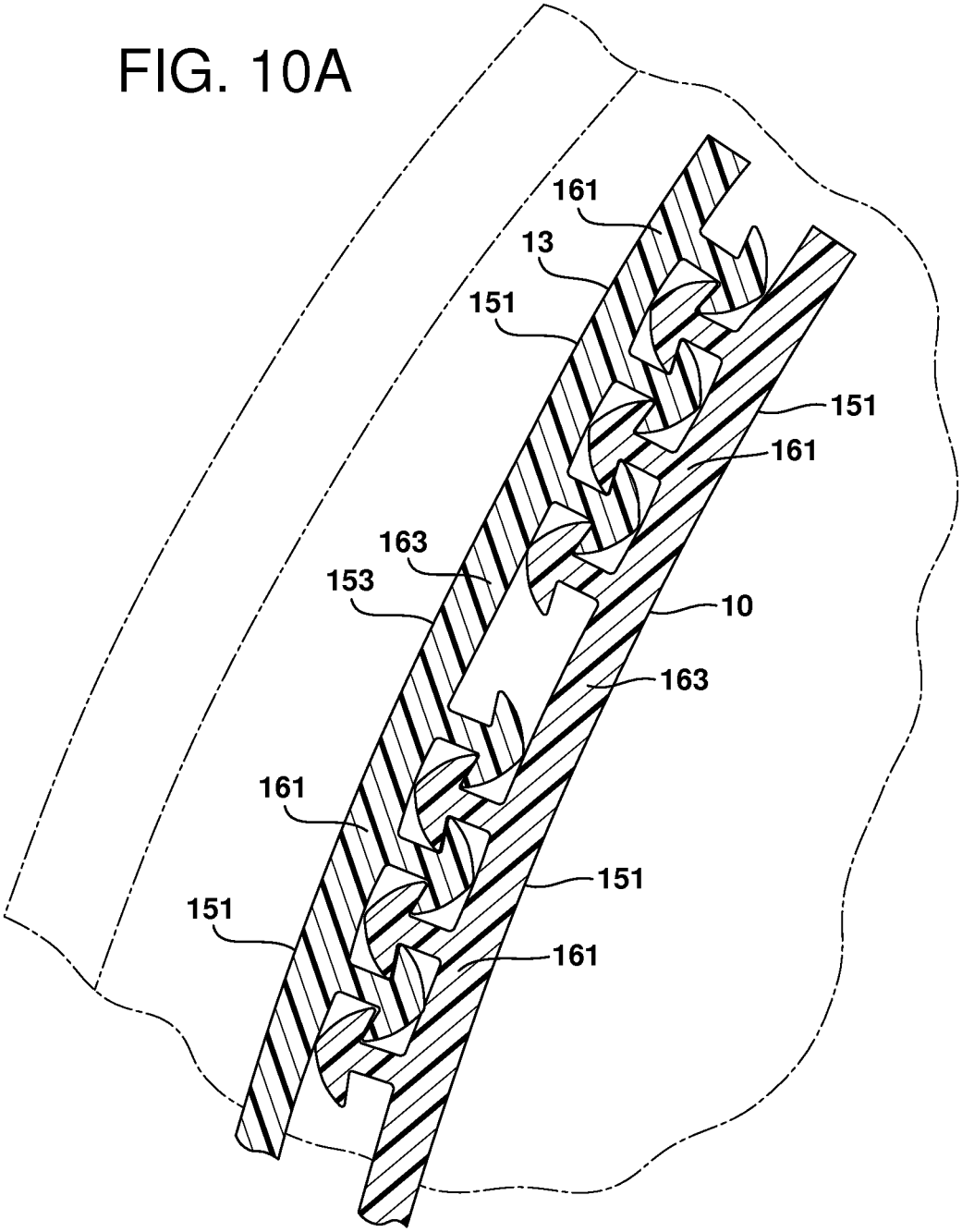
FIG. 10A is an enlarged cross-sectional view of the package of FIG. 10.

Strip 10 can optionally include a first skirt segment denoted by region $S_L$, and/or a second skirt segment denoted by region $S_R$. These skirt segments may be useful in the manufacture of strip 10, and may also be useful in anchoring strip 10 to a web. Skirt segment $S_L$ is shown with a base portion 263, a base surface 253 and a second surface 254. Skirt segment $S_R$ is shown with a base portion 265, a base surface 255 and a second surface 256. Strip 10 can alternatively include additional or alternative skirt segments such that interlocking segment "D" is bounded on some or all of its sides by a skirt segment. Skirt segments can in some embodiments be disposed in an intermediate position along the length of the strip, e.g. can be flanked by two interlocking segments e.g. as shown in FIG. 10A.

Strip 13 can be configured like first interlocking strip 10, or can be of any suitable alternative construction, provided it can be brought in interlocking engagement with strip 10 to reclose the package after the package has been initially opened.

Figure 6A:
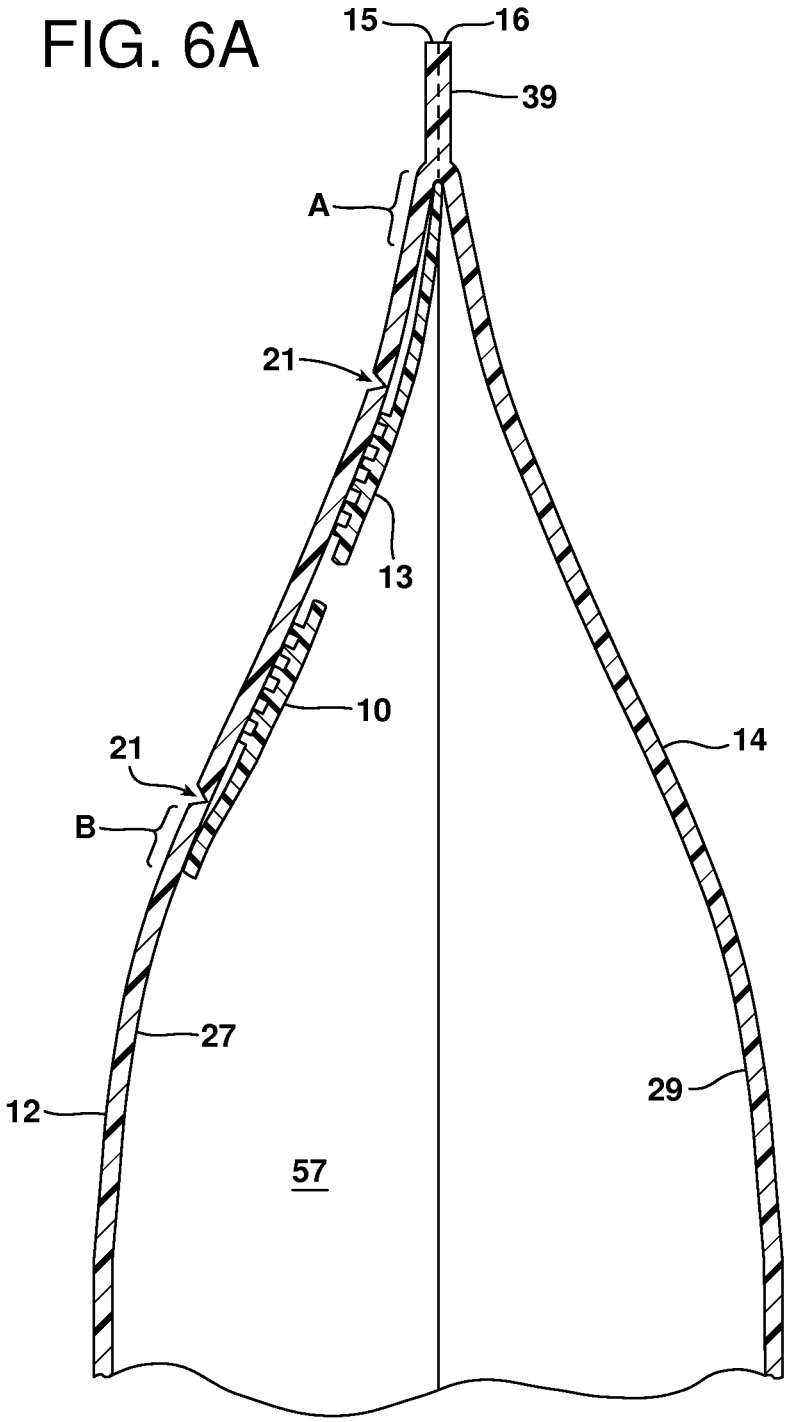
FIG. 6A is a cross-sectional view of a portion of the package of FIG. 1, viewed along lines 6-6 of FIG. 1.
Figure 6B:
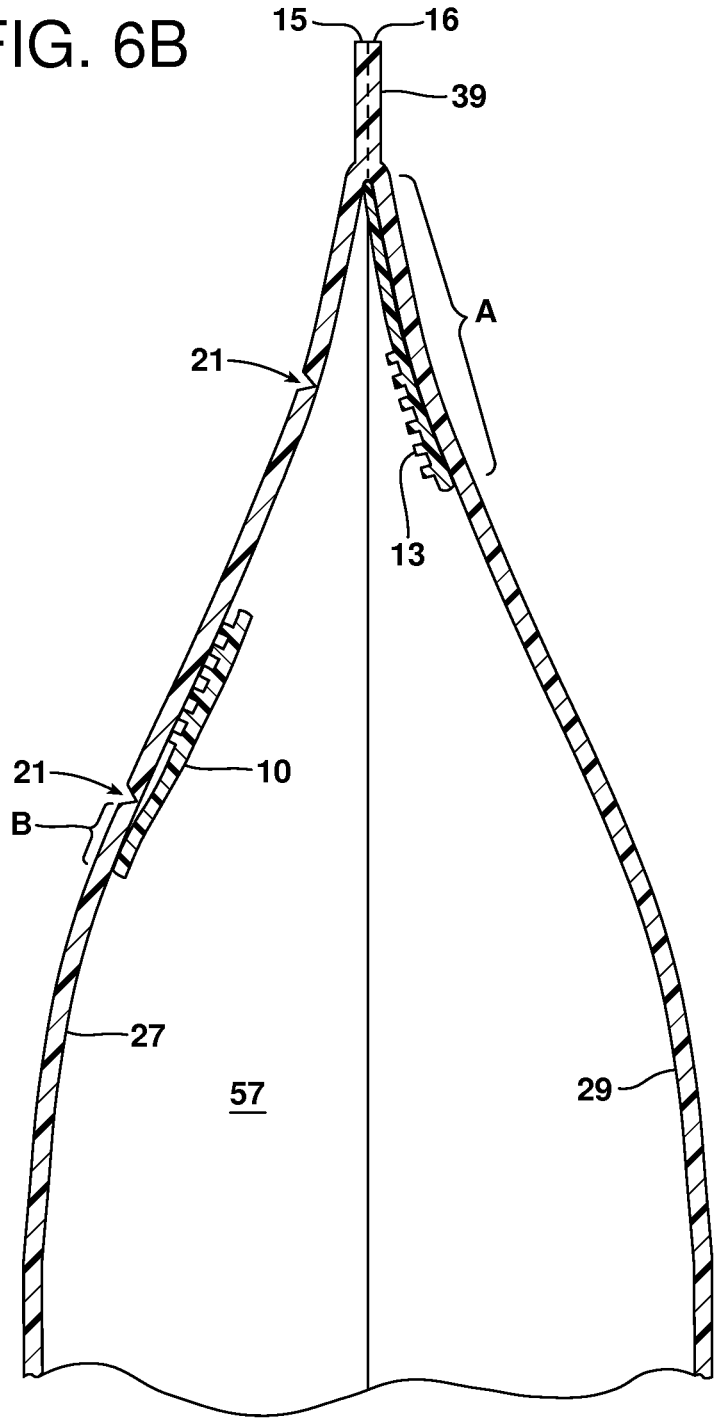
FIG. 6B is a cross-sectional view of a portion of the package of FIG. 1, according to another embodiment, viewed along lines 6-6 of FIG. 1.
Figure 7A:
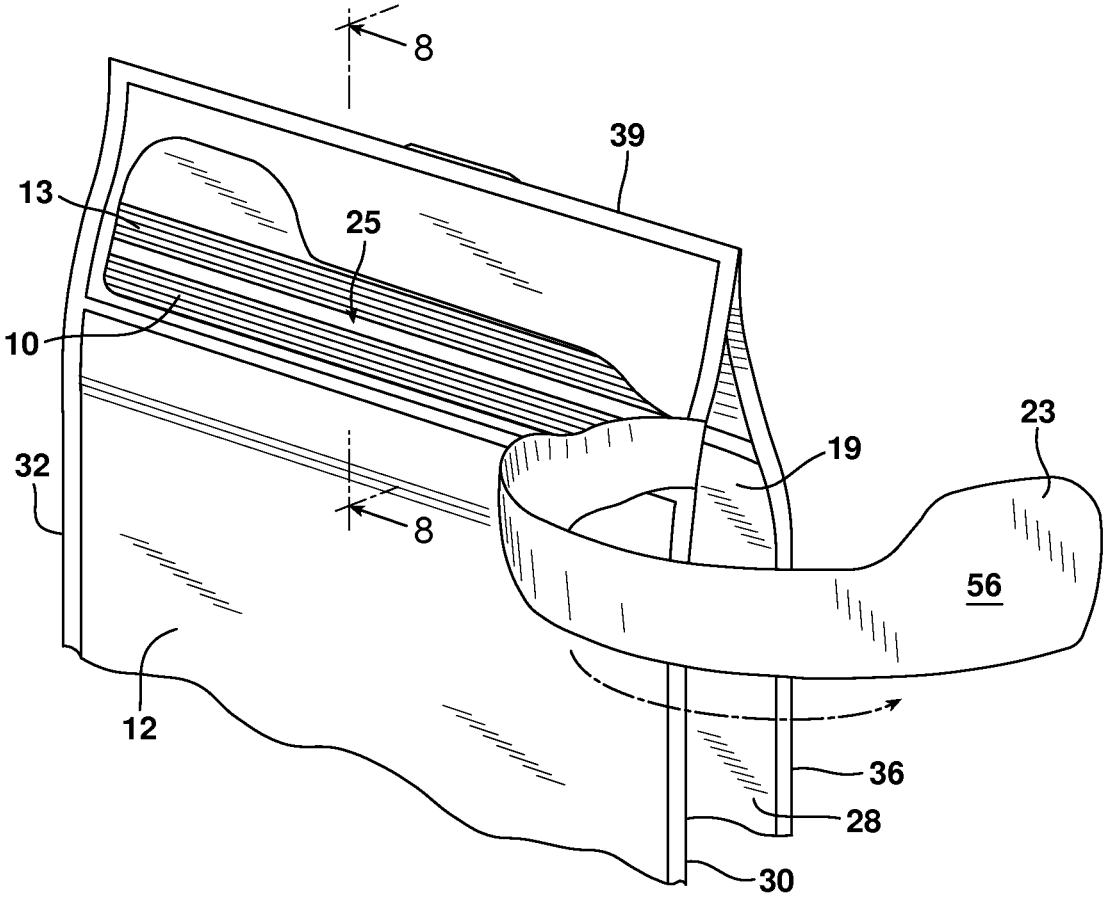
FIG. 7A is a perspective view of a portion of the package of FIG. 1 during an opening sequence.
Figure 7B:
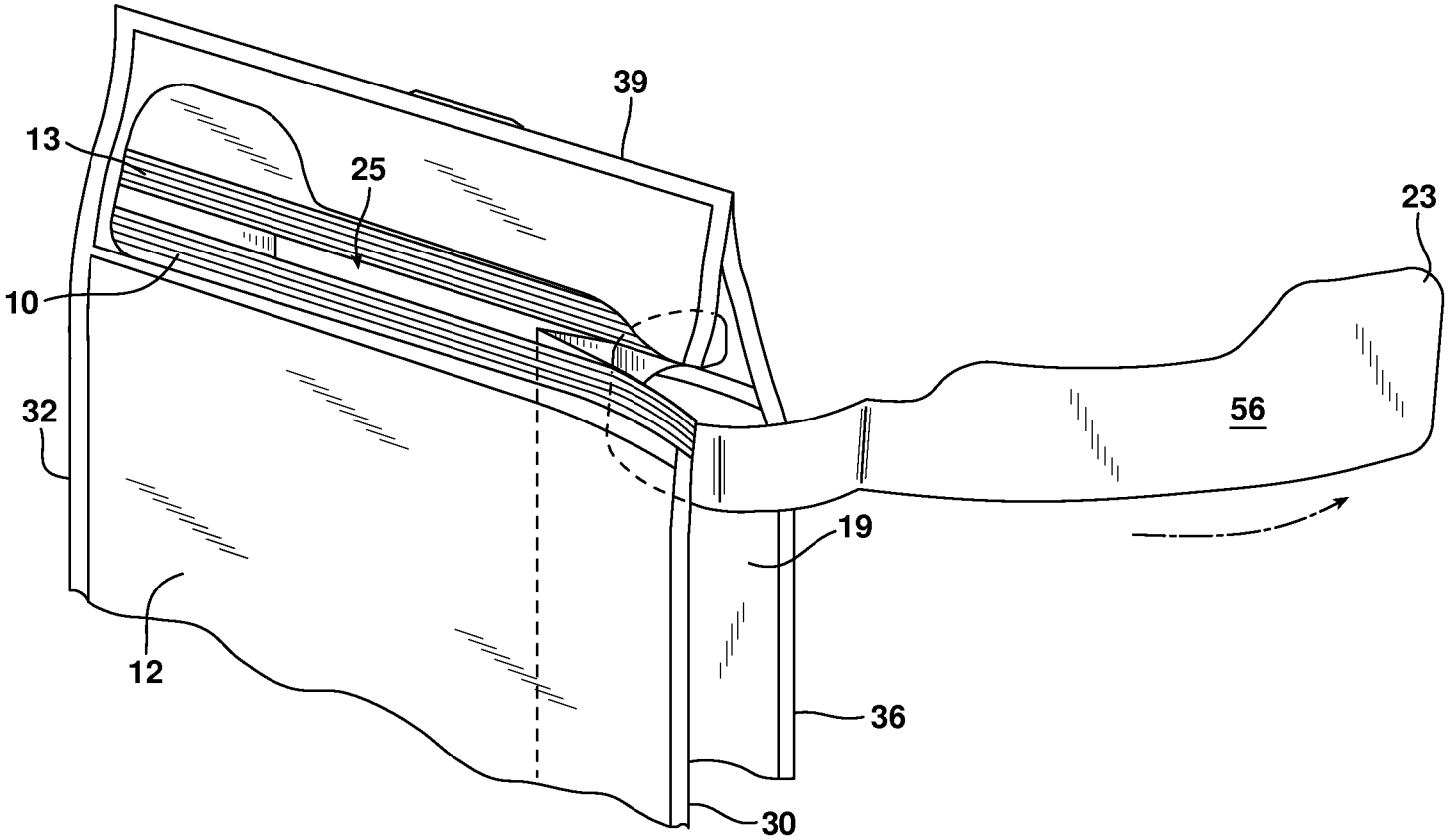
FIG. 7B is a perspective view of a portion of the package according to FIG. 7A, later in the opening sequence.
Figure 8A:
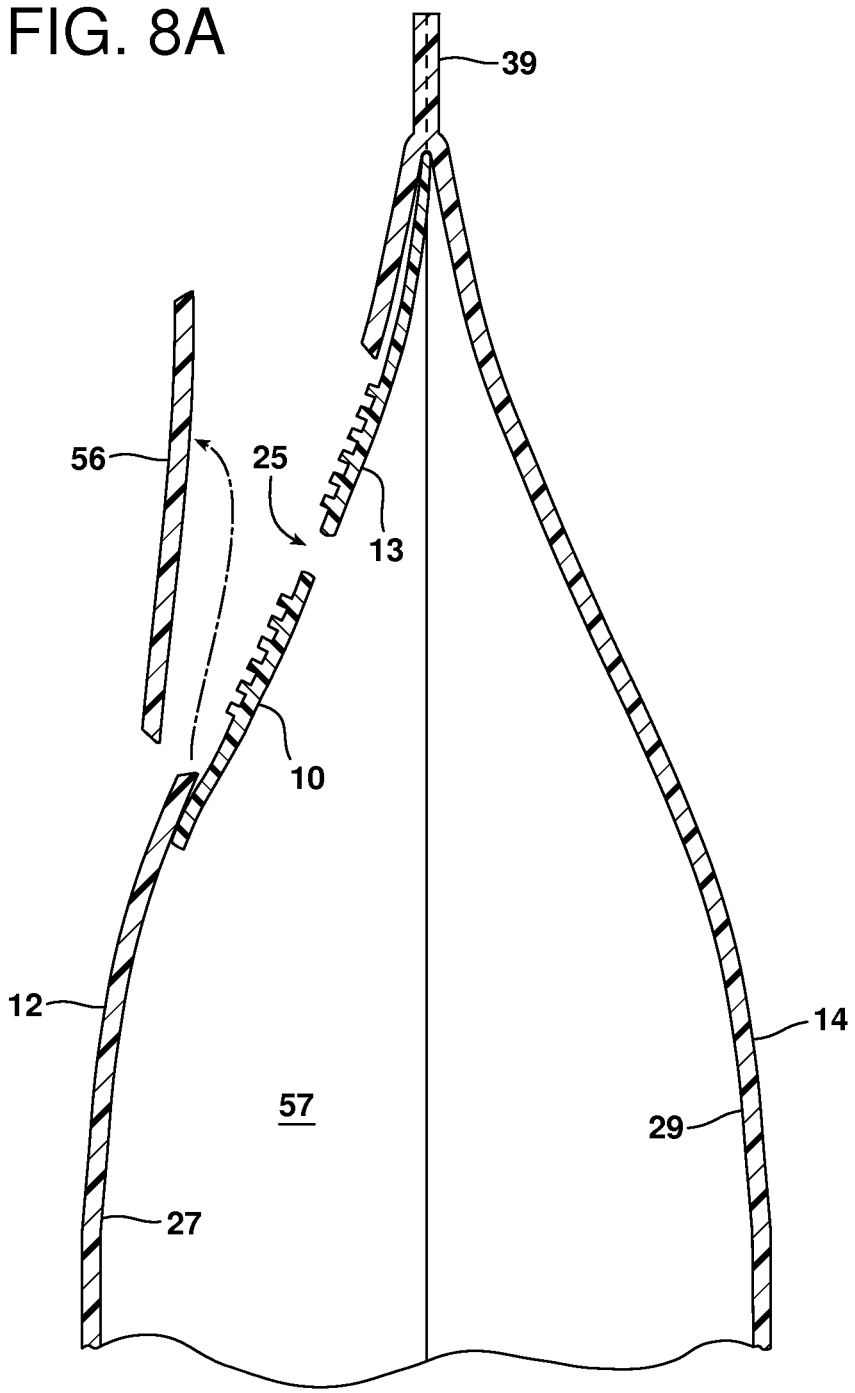
FIG. 8A is a cross-sectional view of the package of FIG. 6A during an opening sequence.
Figure 8B:
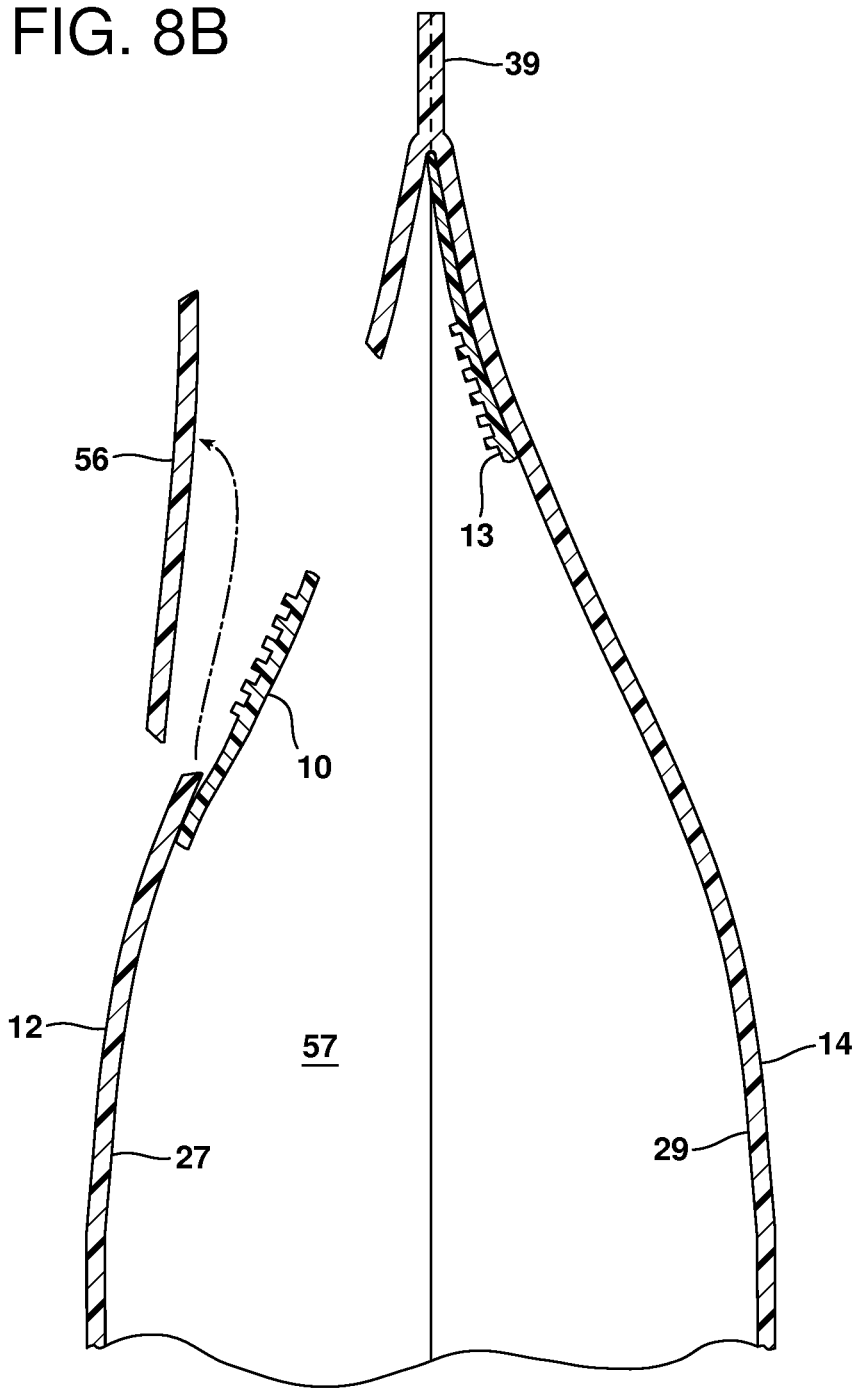
FIG. 8B is a cross-sectional view of the package of FIG. 6B during an opening sequence.
Figure 11:
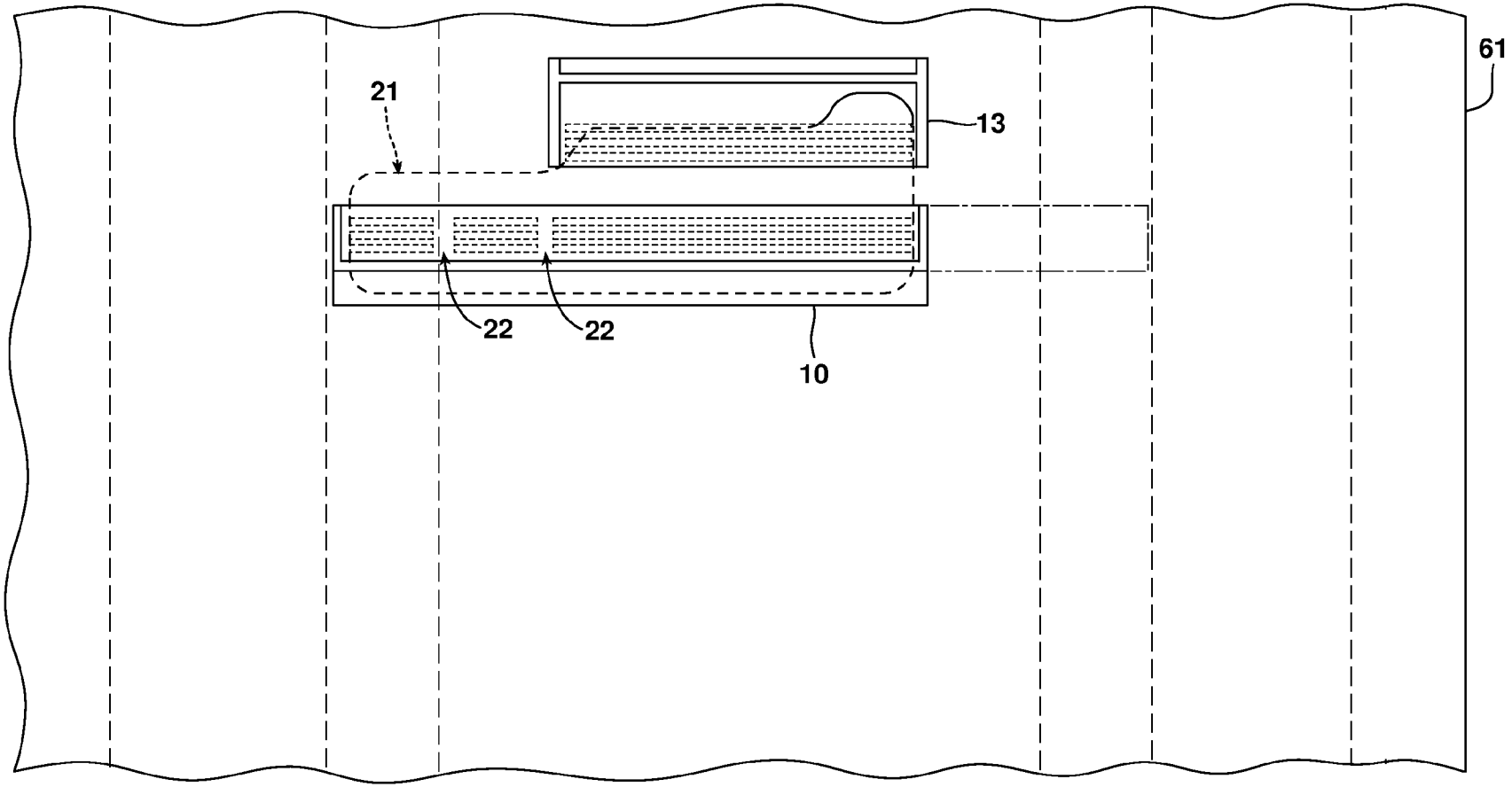
FIG. 11 is a plan view of a portion of a lay-flat web with the reclosure mechanism and die cut thereon, for making the package of FIG. 1.

In one embodiment (see e.g. FIGS. 1, 2, 7A and 7B, and 11) first side panel 12 and first gusset 19 include a die cut 21 defining die cut segment 56. A first portion of strip 10 is anchored to the inner surface 27 of first side panel 12, and a second portion of strip 10 is anchored to the inner surface of first gusset 19, at anchor region "B" with a relatively strong seal. Optionally, another portion of strip 10 is sealed to the inner surface 27, and the inner surface of first gusset 19, with an easy-open heat seal. Strip 13 is anchored to the inner surface 27 of first side panel 12 (see FIG. 6A), or to the inner surface 29 of second side panel 14 (see FIG. 6B), at anchor region "A" with a relatively strong seal. The package can be made from a lay-flat web 41 such as that shown in FIG. 11. The web includes strips 10 and 13 applied thereto, and die cut 21 forming a die cut segment 56. Strip 10 is longer than strip 13, and the segment of strip 10 that extends to the left in FIG. 11, i.e. the portion furthest from first longitudinal edge 61 (see also FIG. 20A), will be the segment that in the finished bag is anchored to the inner surface of front gusset panel 26 and rear gusset panel 28 of first gusset 19. Clear areas 22, which are regions of the strip that either do not include interlocking surfaces, or include interlocking surfaces that have been e.g. removed, or heated and pressed or otherwise rendered inoperable, are suitable for and accommodate the production of rib seals 30 and 36.

Figure 17:
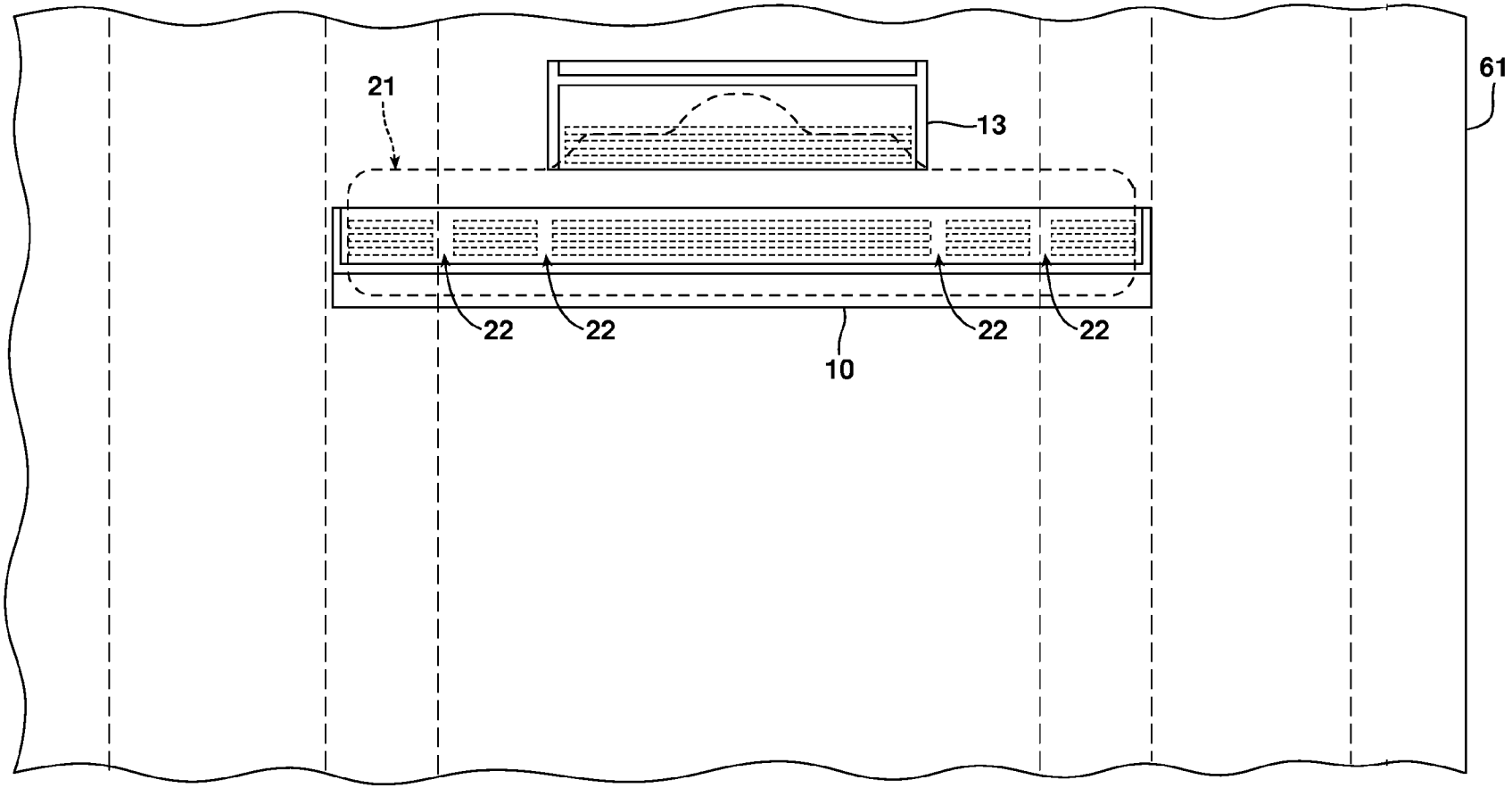
FIG. 17 is a plan view of a portion of a lay-flat web with the reclosure mechanism and die cut thereon, for making the package of FIG. 12.

In another embodiment (see especially FIGS. 12 through 17) first side panel 12 and first and second gussets 19 and 20 include a die cut 21 defining die cut segment 56. A first portion of strip 10 is anchored to the inner surface 27 of first side panel 12, and a second and third portion of strip 10 is anchored to the inner surface of first and second gussets 19, 20 respectively, at anchor region "B" with a relatively strong seal. Optionally, another portion of strip 10 is sealed to the inner surface 27, and/or the inner surface of either or both of gussets 19 and 20, with an easy-open heat seal. Strip 13 is anchored to the inner surface 27 of first side panel 12 or to the inner surface 29 of second side panel 14 at anchor region "A" with a relatively strong seal. The package can be made from a lay-flat web 41 such as that shown in FIG. 17. The web includes strips 10 and 13 applied thereto, and die cut 21 forming a die cut segment 56. Strip 10 is longer than strip 13, and the segments of strip 10 that extends to the left and to the right in FIG. 17, i.e. the portion furthest from and closest to first longitudinal edge 61 (see also FIG. 20B), will be the segments that in the finished bag are anchored respectively to the inner surface of front gusset panel 26 and rear gusset panel 28 of first gusset 19, and to the inner surface of front gusset panel 35 and rear gusset panel 37 of second gusset 20. Clear areas 22 are suitable for and accommodate the production of rib seals 30 and 36, as well as rib seals 32 and 38.

The interlocking surfaces of strips 10 and 13 are typically spaced apart from the first and second ends of the package, with strips 10 and 13 positioned substantially parallel to one another, and the interlocking surfaces of strips 10 and 13 spaced apart from each other sufficiently to enable the package, after opening, to be folded such that the interlocking surface of second strip 13 can be brought into engagement with the interlocking surface of the first portion of the first strip 10 to reclose the package.

The invention is characterized by the fact that when the die cut segment is displaced, and the package is opened,

- the product can be accessed between the first and second interlocking strips, and
- the interlocking surface of each of the first and second interlocking strips is at least partially exposed.

The invention is characterized by the fact that when the die cut segment is removed, the package can thereafter be reclosed by engaging the interlocking surface of the second portion of the first interlocking strip with itself, folding the package, and engaging the interlocking surface of the second interlocking strip with the interlocking surface of the first portion of the first interlocking strip.

Other characteristics of each of the embodiments of the invention:

- before the package is initially opened, the interlocking surfaces of the first and second interlocking strips are not exposed.
- the interlocking surfaces of the second interlocking strip, and of the first portion of the first interlocking strip, are not engaged until the package is initially opened and then reclosed.
- the interlocking surface of the first interlocking strip is farther from the first end of the package than the interlocking surface of the second interlocking strip.
- the first interlocking strip is longer than the second interlocking strip.

In embodiments where an easy-open seal is present, displacing the die cut will typically break the easy-open seal, or if more than one easy-open seal is present, break at least one of the easy-open seals, and open the package and provide access to the package contents.

Within the above parameters, strips 10 and 13 can be of any suitable dimension and shape, are typically thermoplastic, and will typically be longer in length than in width, with the length of the strip 10 being e.g. greater than two times the width of the strip, e.g. greater than 3, 4, or 5 times the width. A typical dimension for the strips is a width of from about 0.25 inches to 1.5 inches and a length, for strip 10 for the embodiment shown in FIG. 11*b* of about 9 inches, and for strip 10 for the embodiment shown in FIG. 17, about 12 inches; and for strip 13 for either embodiment, about 6 inches. The strips will be shorter in at least one dimension than the pouch and package. The strips can each be of any suitable thickness, for example have a thickness of between 10 and 100 mils, such as between 20 and 80 mils, between 30 and 70 mils, or any thicknesses therebetween.

One or more of the surfaces of strips 10 and 13 comprise a sealant. In one embodiment, the second surface 254 of skirt segment $S_L$ of strip 10 is anchored to the inner surface 27 of the first side panel 12, and surfaces 251, 253 and/or 255 of strip 13 are anchored to the inner surface 29 of the second side panel 14. In this arrangement, optionally the second surface 256 of skirt segment $S_R$ is sealed to the inner surface 27 of the first side panel 12 with an easy open seal. In some embodiments, the first and second strips 10 and 13 are sealed to the inner surfaces 27 and 29 of first and second side panels 12, 14 respectively only along the first and second side edges of the package. In other embodiments, the strips are sealed to the respective inner surfaces of the package along a portion of, or along the entire width of the package. Various skirt segments within a strip can have an easy-open seal and a relatively strong seal, depending e.g. on the need for hermeticity of the original, unopened package.

Strips 10 and 13 (and strips 74, 75, and 774, 775 discussed further herein) can be self-mating, in which case the same interlocking type can be used for both strips, including the segments disposed on the first and second gussets that are configured to engage to themselves upon closing the package. Alternatively, strips 10 and 13 can be dissimilar in terms of the nature of the interlocking surface, provided that when the package is reclosed, the first portion of strip 10 can be engaged with strip 13. Likewise, in each of the gusset areas of the package, self-mating or non-self-mating strip materials can be used, and can e.g. be applied to the lay-flat web as discrete segments, discontinuous with the main portion of strip 10, 74, 774, provided that in each gusset, the strip segments can be engaged to themselves upon closing the package.

When a product 24 is placed in the pouch 7, by processes herein disclosed, and the pouch 7 is closed, the package 5 is made.

Method of Operation

The package of the invention can be easily manually opened, by displacing the die cut segment 56.

Figure 2:
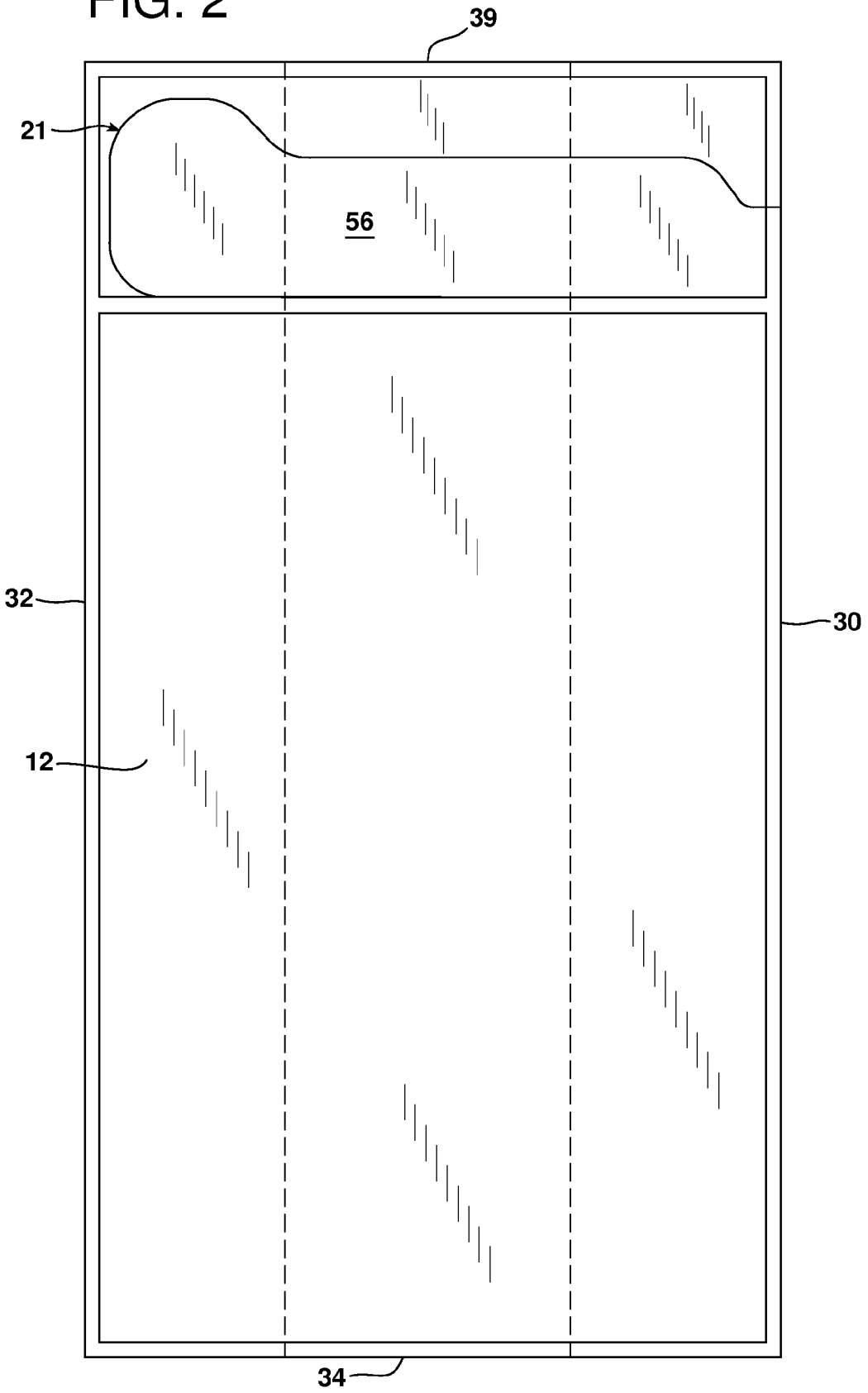
FIG. 2 is a front elevational view of the package of FIG. 1.
Figure 3:
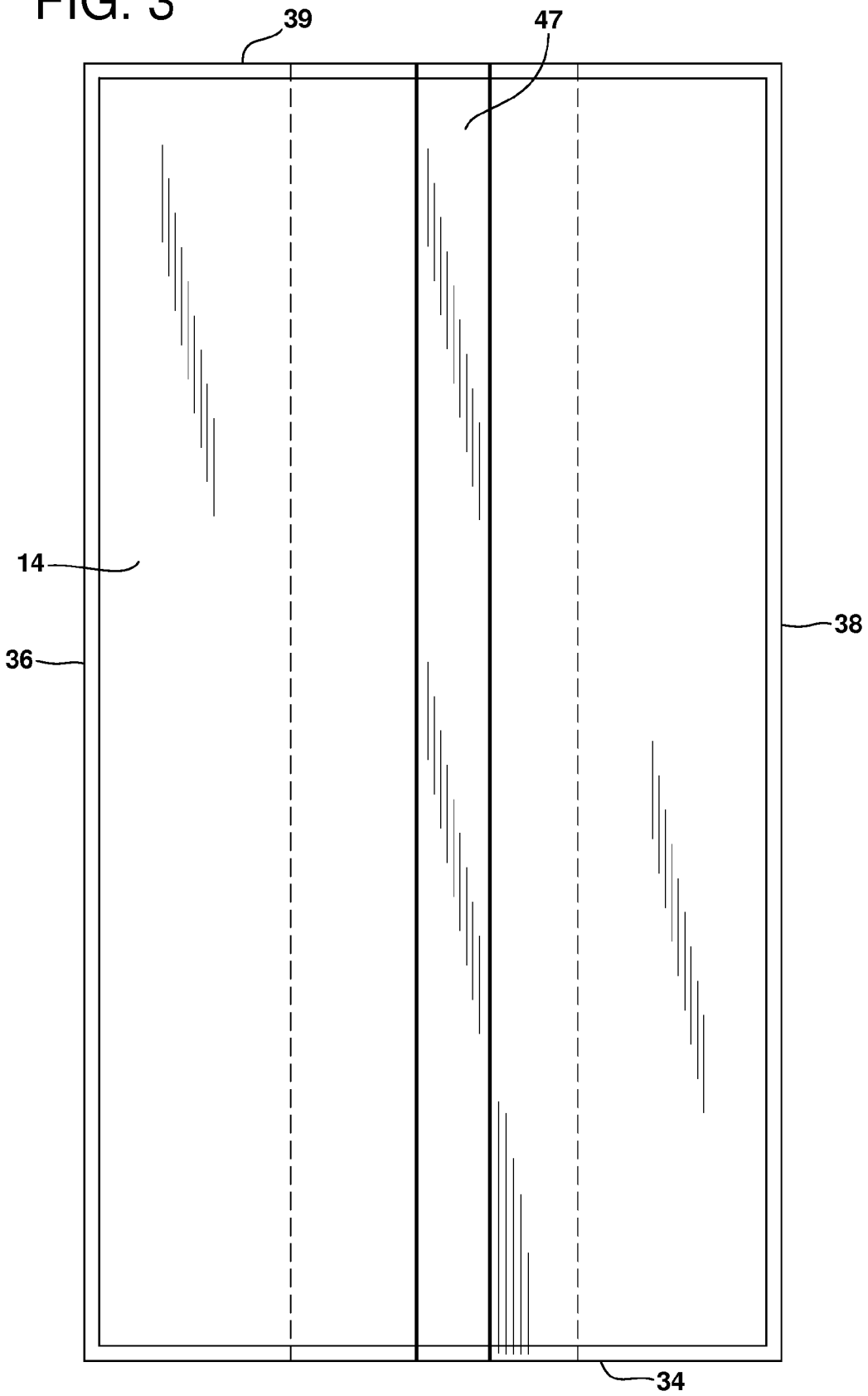
FIG. 3 is a rear elevational view of the package of FIG. 1.
Figure 4:
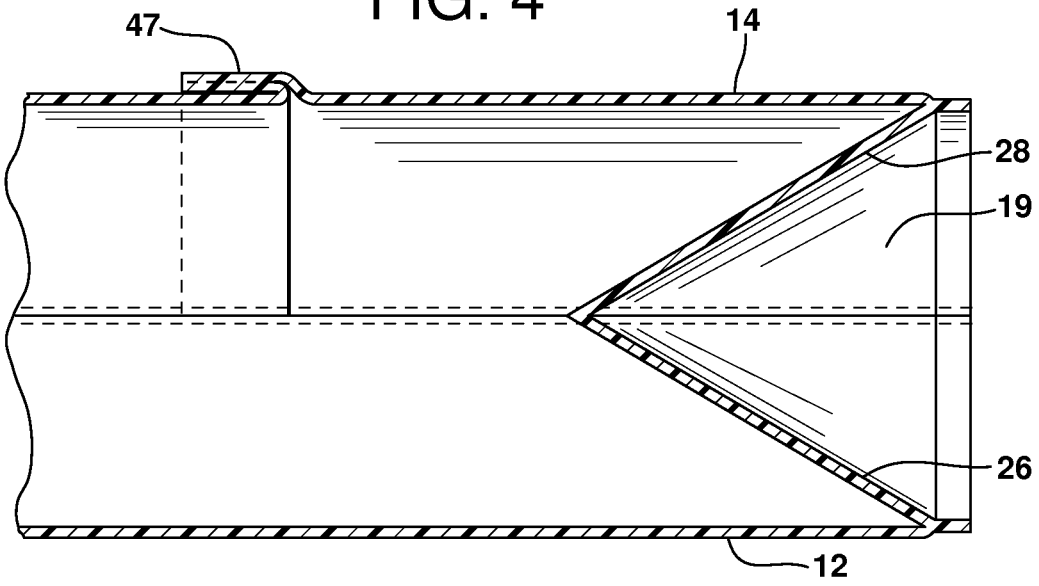
FIG. 4 is a cross-sectional view of a portion of the package of FIG. 1, viewed along lines 4-4 of FIG. 1.
Figure 5:
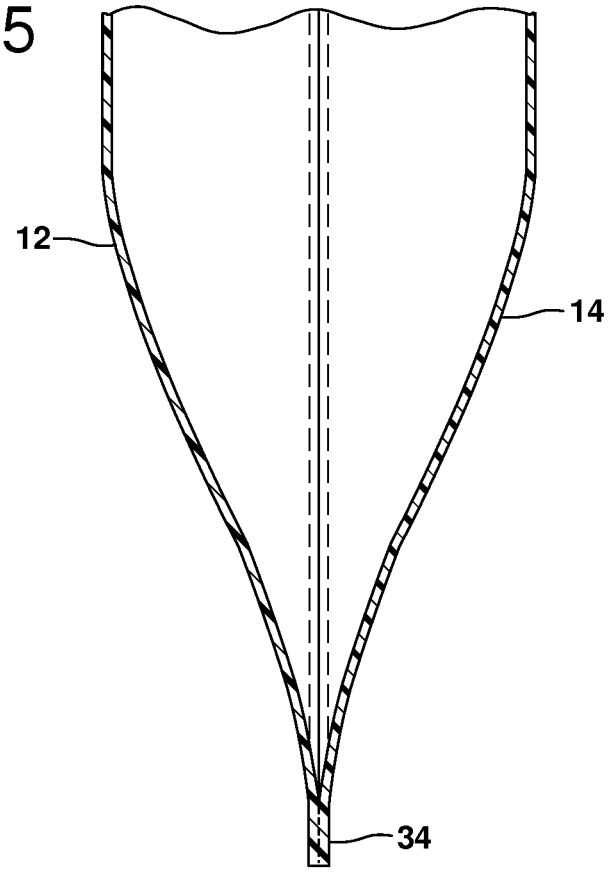
FIG. 5 is a cross-sectional view of a portion of the package of FIG. 1, viewed along lines 5-5 of FIG. 1.
Figure 9:
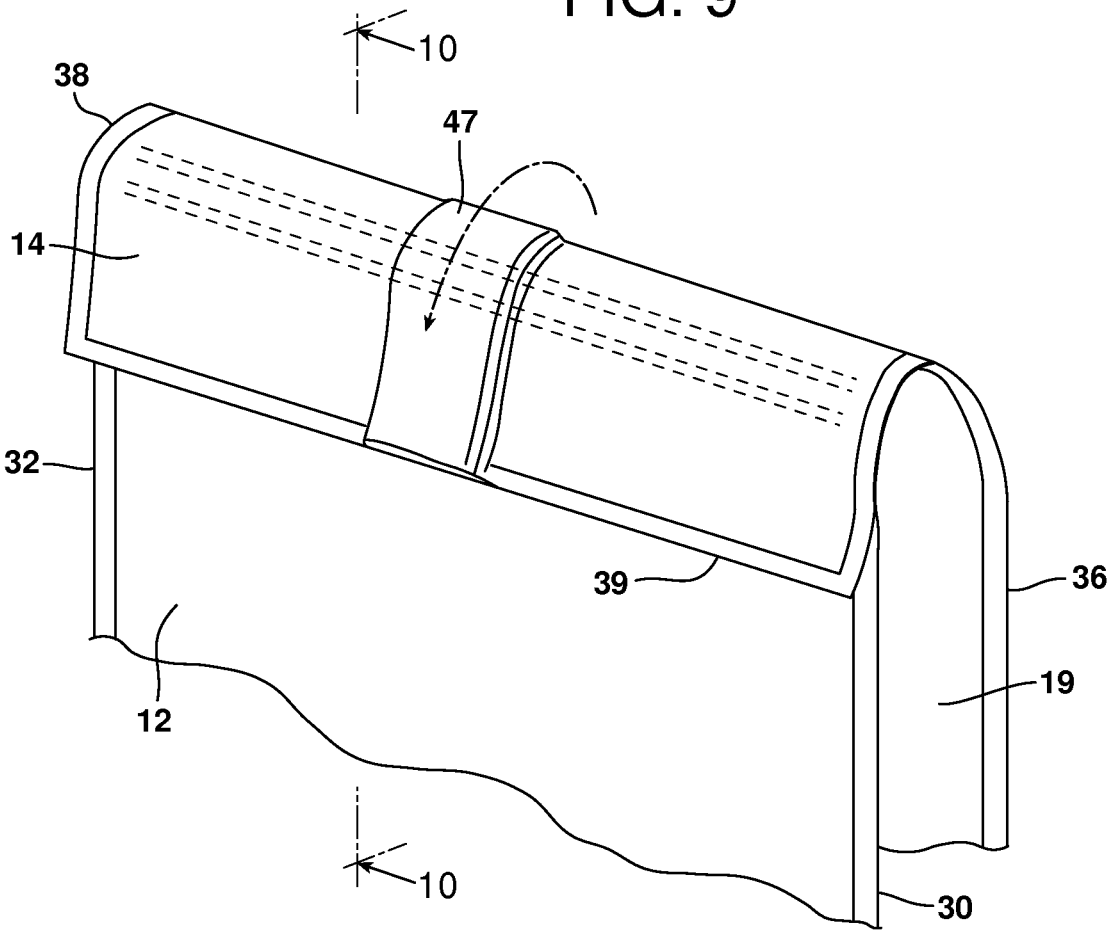
FIG. 9 is a perspective view of a portion of the package of FIG. 8A after it has been reclosed.

In one embodiment, (see FIGS. 7A and 7B) an upper portion of die cut segment 56, at which the die cut 21 extends entirely through the first side panel 12 (i.e. a through-cut), defines an opening tab 23 in an upper region of the package, and disposed toward the left side of the front of the package as viewed in FIG. 2. Tab 23 can be grasped and pulled laterally across the face of the package to initiate and propagate displacement of die cut segment 56 from the side panel 12 and the first gusset 19. Another portion of die cut segment 56 in the first side panel, as well as in first gusset 19, is defined from a portion of die cut 21 that extends partially through the first side panel and the first gusset (i.e. a score). When a sufficient displacement of die cut segment 56 is completed, the package is opened and the contained product 24 can be accessed. As the first side panel 12 is grasped at opening 25 and pulled toward the user, i.e. away from second panel 14, an advantage of this embodiment is that the accessible opening 25 produced is relatively large, since the opening and accessing of product will typically involve both the movement of the first side panel 12 toward the user, as well as the expansion or spreading of the front gusset panel 26 and rear gusset panel 28 of first gusset 19. After the desired amount of product has been removed, the package can be reclosed by removing the die cut segment (if not already done during opening of the package), engaging the interlocking surface of the second portion of strip 10 ((i.e. that portion disposed on front and rear gusset panels 26,28) with itself, folding the package over (see FIG. 9), and engaging the interlocking surface of strip 13 with the interlocking surface of the first portion of strip 10 (i.e. that portion disposed on side panel 12). With respect to the former step, the two parts of the second portion of strip 10, attached to the two gusset panels 26 and 28, are pressed together by exerting pressure against both the first and second gusset panels in the region of the package where the second portion of strip 10 is located, so as to pinch the strip 10 closed on itself.

This embodiment has been described with the tab 23 on the upper left side of the first side panel 12, and the die cut segment in the first side panel and first gusset 19. Alternatively, tab 23 can be disposed toward the upper right side of the front of the package, and the die cut segment can be in the first side panel and second gusset 20, with the second portion of strip 10 being that portion disposed on front and rear gusset panels 35,37, but the basic principle of operation will, mutatis mutandis, be the same.

In another embodiment, (see FIGS. 14 and 15) an upper portion of die cut segment 56, at which the die cut 21 extends entirely through the first side panel 12, defines an opening tab 23 in a central upper region of the package. Tab 23 can be grasped and pulled toward the user, i.e. away from the plane of the package, to initiate and propagate displacement of die cut segment 56 from the side panel 12 and gussets 19 and 20. Another portion of die cut segment 56 in the first side panel, as well as in gussets 19,20, is defined from a portion of die cut 21 that extends partially through the first side panel and the first and second gussets. When a sufficient displacement of die cut segment 56 is completed, the package is opened and the contained product 24 can be accessed. As the first side panel 12 is pulled toward the user, an advantage of this embodiment is that the accessible opening 25 produced is relatively large, since the opening and accessing of product will typically involve both the movement of the first side panel 12 toward the user, as well as the expansion or spreading of both front gusset panel 26 and rear gusset panel 28 of first gusset 19, and front gusset panel 35 and rear gusset panel 37 of second gusset 20. After the desired amount of product has been removed, the package can be reclosed by removing the die cut segment (if not already done during opening of the package), engaging the interlocking surface of the second portion of strip 10 ((i.e. that portion disposed on front and rear gusset panels 26,28) with itself; and engaging the interlocking surface of the third portion of strip 10 ((i.e. that portion disposed on front and rear gusset panels 35,37) with itself; folding the package over (see FIG. 16); and engaging the interlocking surface of strip 13 with the interlocking surface of the first portion of strip 10 (i.e. that portion disposed on side panel 12).

In any of these embodiments, the package can be reopened and reclosed several times.

Strip 10 is anchored to the inner surface 27 of first side panel 12, and the inner surface of first gusset 19 and/or second gusset 20, at anchor region "B" with a relatively strong anchor seal. Strip 13 is anchored to the inner surface 27 of first side panel 12 (see FIG. 6A), or to the inner surface 29 of second side panel 14 (see FIG. 6B), at anchor region "A" with a relatively strong anchor seal. Anchor seals insure that strips 10 and 13 remain attached to relevant portions of the package during opening and reclosing of the package.

Optionally, an easy-open seal, of any suitable geometry, can be used to seal the end of strip 10 closest to the first end of the package to the inner surface of first side panel 12; to second strip 13; or to the inner surface of the second side panel 14. The easy-open seal can be installed at any suitable location in the package, and when appropriately placed, helps reduce the possibility that oxygen from outside the package can enter the unopened package, e.g. through the die cut, as well as facilitating filling of the pouch with product before the package is sealed. An easy-open seal can be made by the use of an easy-open sealant placed on the surface of, or forming a surface layer of, any of strips 10 and 13, or the inner surface of the first or second side panel. Alternatively, a discrete film with an easy-open functionality can be installed at any suitable location in the package, such as between and attaching the inner surface of the first side panel to the end of strip 10 closest to the first end of the package, to second strip 13, or to the inner surface of the second side panel. Where an easy-open seal is present, any suitable mechanism for obtaining this functionality and feature can be used, e.g. a) adhesive failure, where two surfaces each comprises a composition that, when the surfaces are sealed together, form an easy-open seal that provides an interface that breaks apart upon manually opening the package; b) delamination failure, where the interlaminar bonds between layers of a material can be broken, providing an interface that will break apart upon manually opening the package; and c) cohesive failure, where a layer of a material such as a film fractures when the package is opened.

Method of Making a Package

A. Vertical Form/Fill/Seal (VFFS)

Figure 19:
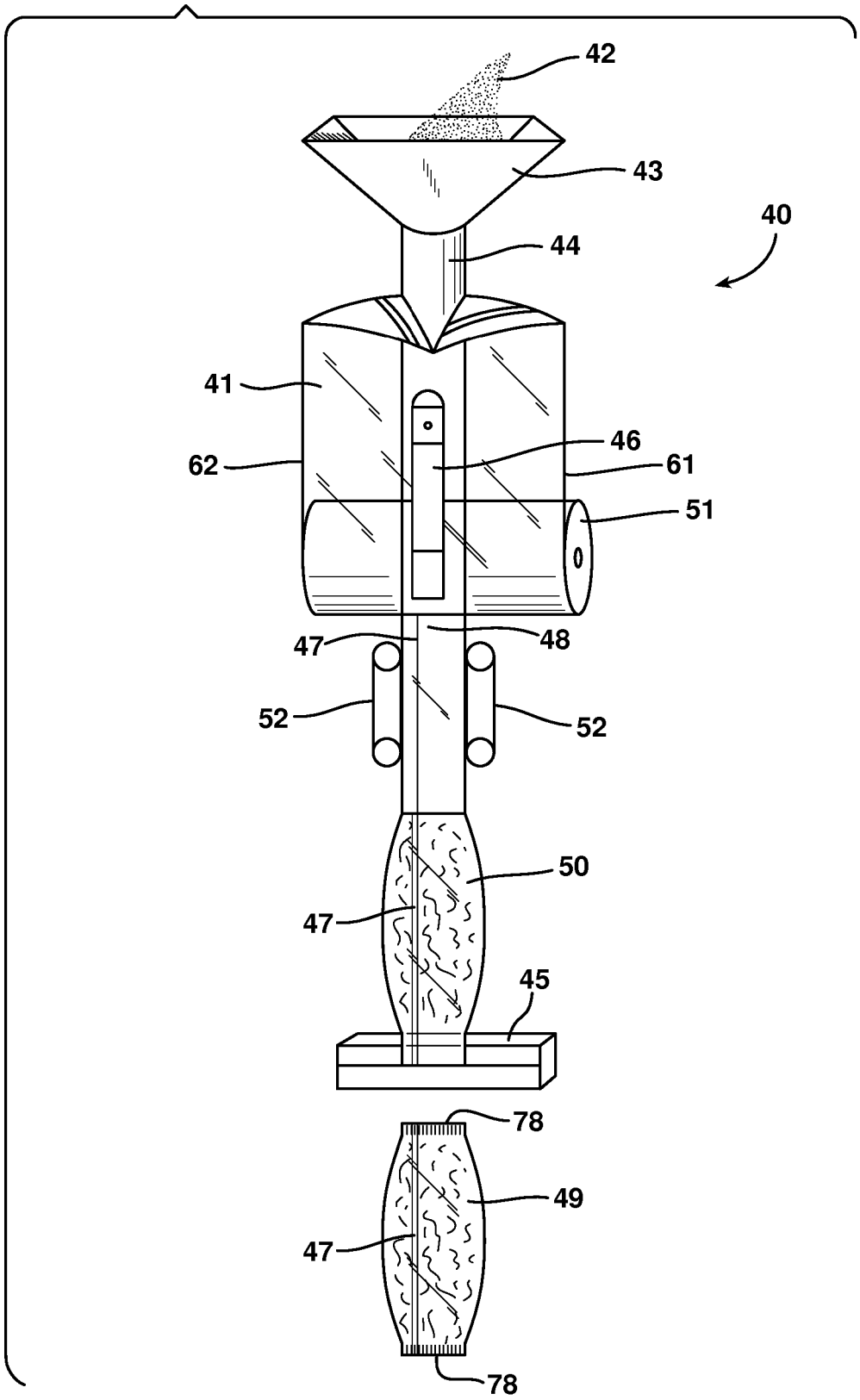
FIG. 19 is an elevational view of a VFFS process and apparatus for making a package.

FIG. 19 shows a VFFS apparatus and process according to some embodiments of the invention. VFFS packaging systems are generally well known and described for example in U.S. Pat. No. 4,589,247 (Tsuruta et al) and U.S. Pat. No. 4,808,010 (Vogan), both incorporated herein by reference in their entirety.

Apparatus 40 utilizes a lay-flat web 41 as a rollstock. Web 41 includes die cuts made in a predetermined pattern (see e.g. FIGS. 11, 17, 20A and 20B). Product 42 is manually or mechanically supplied to apparatus 40, from which a predetermined quantity of product 42 reaches the upper end portion of forming tube 44 via funnel 43, or other conventional means. The packages are formed in a lower portion of apparatus 40, and web 41 is fed vertically upward from feed roll 51, and over forming bars (not shown), wrapped about forming tube 44, and provided with a longitudinal fin seal or lap seal 47 by longitudinal heat sealing device 46, resulting in a vertically-oriented folded web in the form of a tube 48. Transverse heat seal bars 45 close and seal horizontally across the lower end of vertically-sealed tube 48, to form a pouch 49 which is then packed with product 24. Film drive belts 52, powered and directed by rollers or suitable alternative motive means, advance tube 48 and pouch 49 vertically downward a predetermined distance, after which seal bars 45 close and simultaneously seal horizontally across the lower end of vertically-sealed tube 48 and across the upper end of sealed pouch 49 to form a package. The next pouch 50 is then filled with product 42 and advanced, and the cycle is repeated. A cut-off knife (not shown), incorporated with the seal bars 45, severs a lower sealed pouch 49 from the bottom of upstream pouch 50.

Interlocking strips 74 and 75 (FIGS. 20A and 20B), equivalent to strips 10 and 13 respectively, are already installed on the lay-flat web prior to the start of the VFFS packaging process. This can be accomplished off-site from the processor, e.g. by the supplier of the feed roll 51. Strips 74 and 75 are disposed on the web 41 perpendicular to the first and second longitudinal edge 61 and 62, in a predetermined spacing between the strips, between each pair of strips, and between the first and second longitudinal edges of the web. The arrangement of strips 74 and 75 in FIG. 20A corresponds to the first embodiment disclosed in FIGS. 1 and 11; the arrangement of strips 74 and 75 in FIG. 20B corresponds to the second embodiment disclosed in FIGS. 12 and 17.

Alternatively, strips 74 and 75 can be fed onto and optionally attached to the web during the packaging process, before or as web 41 is wrapped about forming tube 44.

Figure 20A:
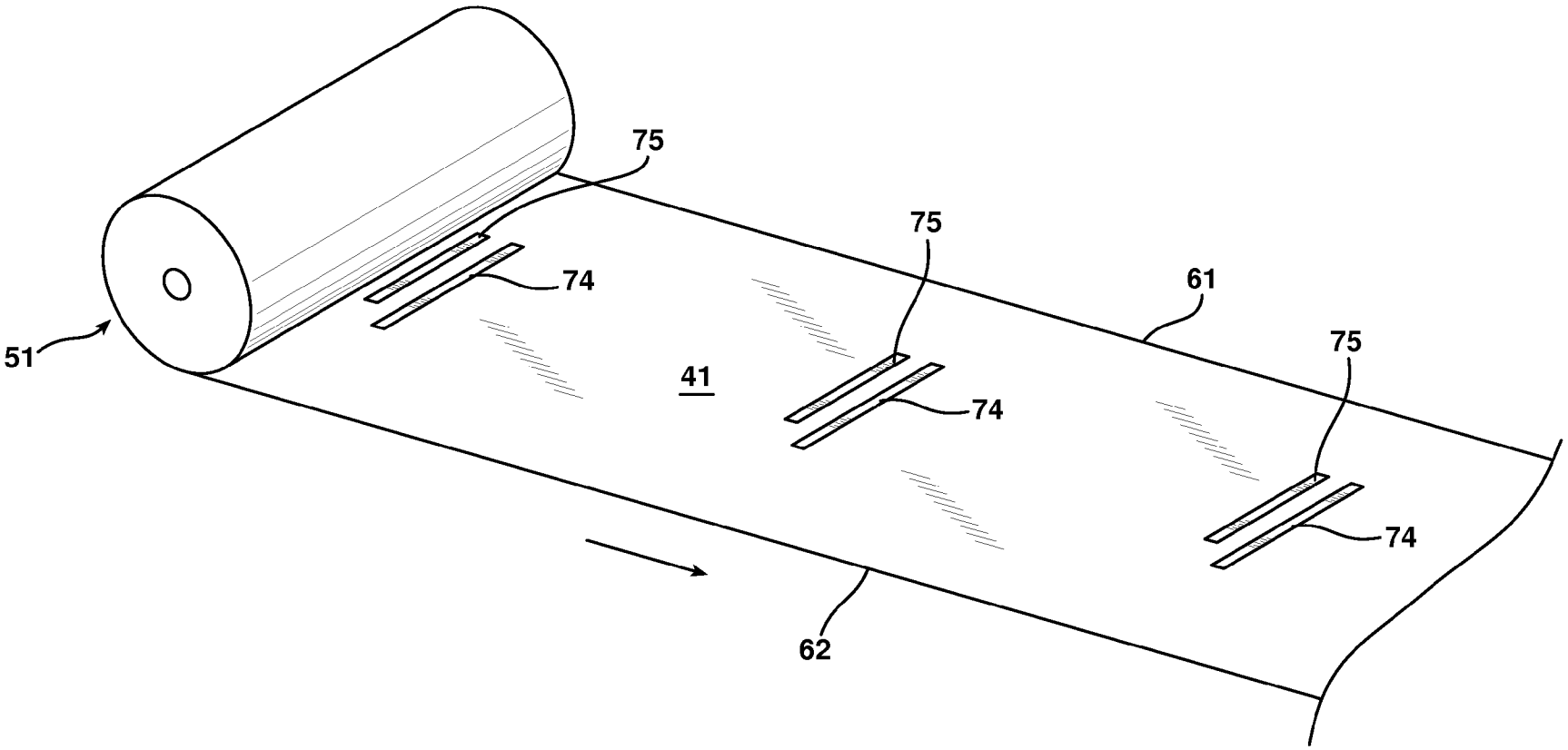
FIG. 20A is a perspective view of a roll of lay-flat film with spaced first and second interlocking strips for making a package in a VFFS or continuous horizontal packaging process.
Figure 20B:
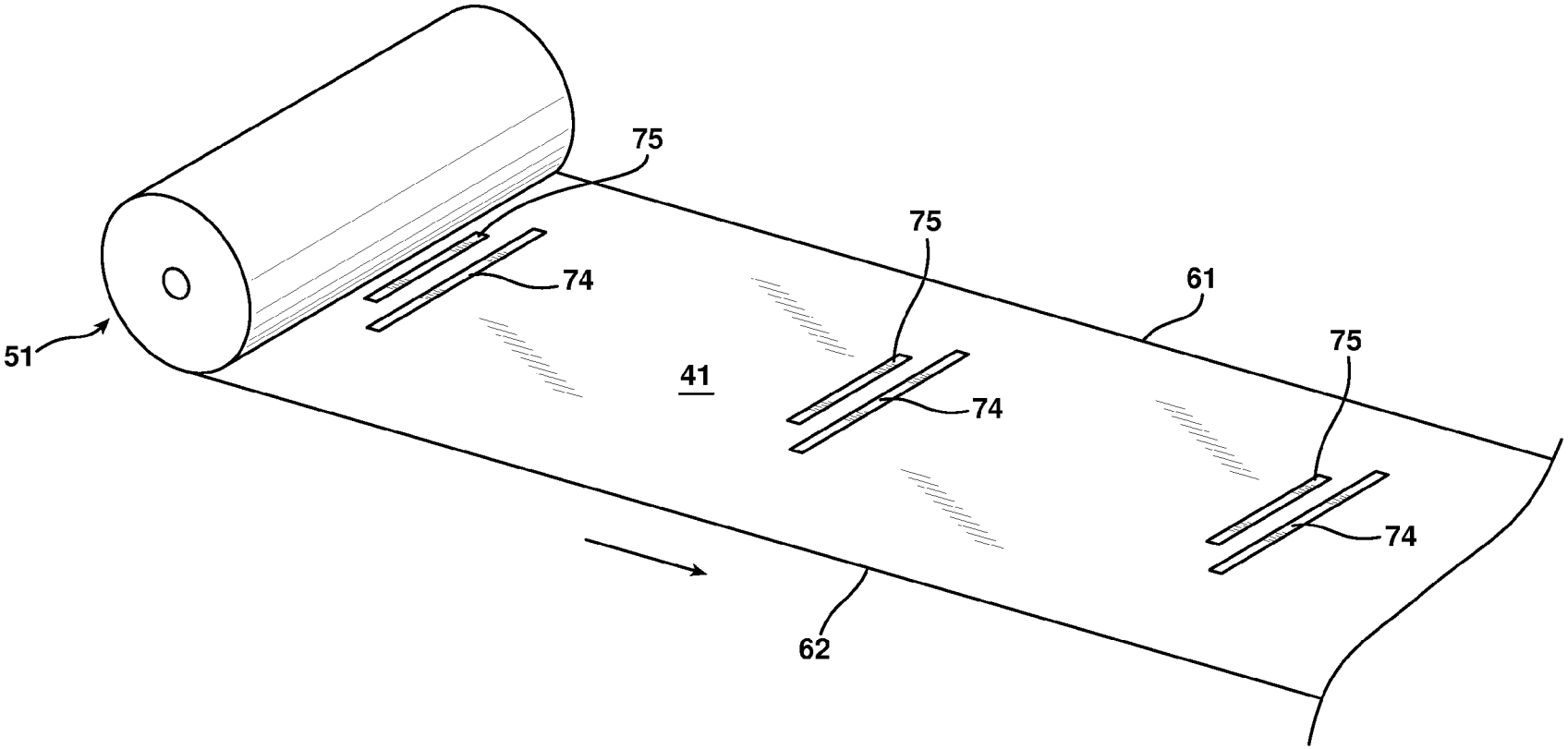
FIG. 20B is a perspective view of a roll of lay-flat film with spaced first and second interlocking strips for making a package in a VFFS or continuous horizontal packaging process according to another embodiment.

Strips 74 and 75 are both oriented such that their base surfaces 251 face the upper surface, as viewed in FIGS. 20A and 20B, of web 41.

In some embodiments, at least one of the web and strips carries a registration device.

At any time before or during the step of making the longitudinal seal 47, strips 74 and 75 are anchored to the lay-flat web or the folded web. This can be done e.g. on the lay-flat web prior to supplying the web to the processor, prior to or as the lay-flat web is advanced to a forming device, or before or during the step of making the longitudinal seal.

B. Continuous Horizontal Packaging

Figure 22:
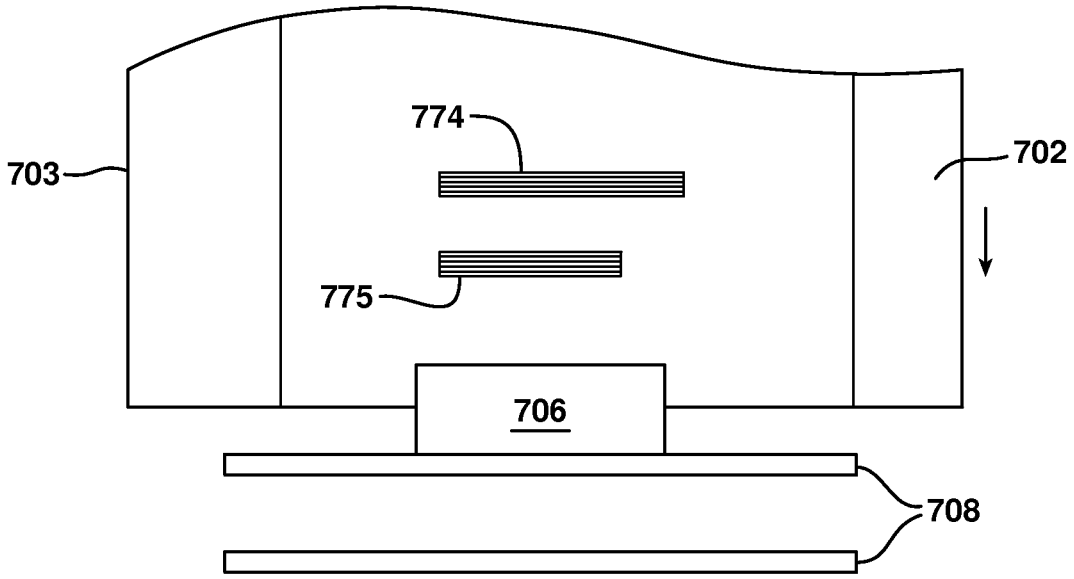
FIG. 22 is a front end view of the apparatus of FIG. 21, viewed along lines 22-22 of FIG. 21.
Figure 21:
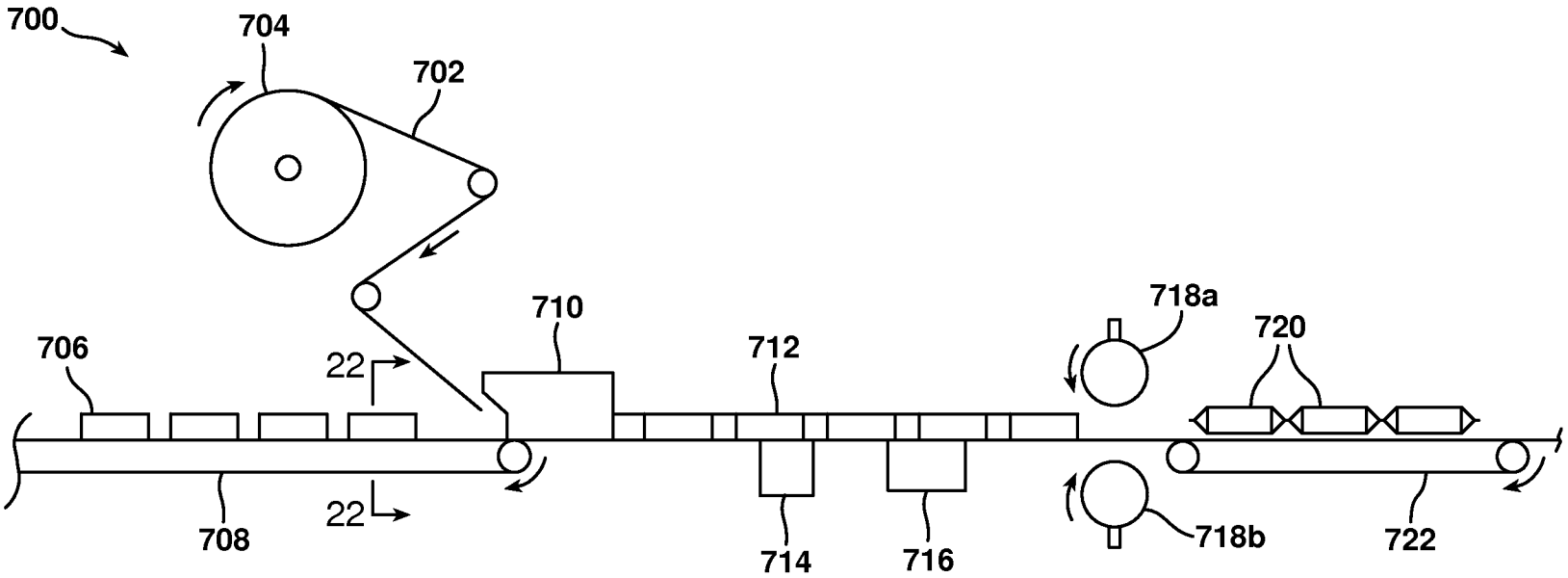
FIG. 21 is an elevational schematic view of a continuous horizontal packaging process and apparatus for making a package.

In another embodiment, and referring to FIGS. 21 and 22, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 21 shows such a process and apparatus 700, but one in which interlocking strips 774 and 775, analogous to strips 10,13 and 74,75 respectively, are installed in a package. Lay-flat web 702, with strips 774 and 775 pre-applied thereon by the supplier of the web, as shown in FIGS. 20A and 20B, is drawn from roll 704 and advanced to forming device 710. As this occurs, a series of products 706 is advanced along conveyor 708 to forming device 710. Web 702 is formed by forming device 710 into folded web 712. This folded web is like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) at the bottom or top of, or along or near a side of, the folded web. The lap or fin seal is typically a heat seal. An alternative is to have a separate sealing device 714 to produce the lap or fin seal. The products travel downstream from forming device 710 and sealing device 714 to transverse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced. Alternatively, the sealing function of transverse sealing device 716 and the cutting function of cutting device 718*a* and 718*b* can be combined at a single station.

Web 702 and interlocking strips 774 and 775 can be of any suitable dimension and composition, such as those disclosed herein. FIG. 22 shows strips 774,775 positioned at right angles to the direction of travel of web 702. The resulting package has a first interlocking strip 774 and a second interlocking strip 775, where both strips can be anchored to the lay-flat web or the formed web at any time before or during the step of making the longitudinal seal. Strips 774 and 775 are each oriented on web 706 such that its base surface 251 faces web 706.

Method of Making a Die Cut in a Web

A conventional die cutter can be used to create die cut 21 in a web used to make first side panel 12 and first and/or second gussets 19 and 20. Die cuts can be made by any suitable conventional process and equipment. Any suitable pattern of die cut can be used, as long as it serves the function of providing an easy-open package in which the packaged product can be accessed by displacement of a die cut segment defined by the die cut. Alternative patterns include elliptical, oval, triangular, rectangular, hour glass, "dog bone", and other regular and irregular shapes. The die cut can extend at different thicknesses through a web. A laser system can be configured to produce a laser cut that cuts partly or completely through the web, or alternatively, a die cut can be made using a mechanical cutting system using rotary engraved dies, or steel rule dies supported in platens as used in reciprocating presses.

The application of interlocking strips on a web, the die cutting of a web, and the assembling of a package incorporated a die cut web and the interlocking strips, can be done at a single location, or at separate locations, with the assembling of the package by a packager using e.g. pre-provided interlocking strips and a die cut web prepared elsewhere and provided in advance of the packaging process.

PACKAGE EXAMPLES

Example 1

A package is made in accordance with the embodiment illustrated in FIG. 1 and described herein, in a vertical form/fill/seal system. The resins are identified in Table 1.

TABLE 1

| Material Code | Tradename Or Designation | Source(s) |
|---|---|---|
| AB1 | 10853 ™ | Ampacet |
| AD1 | PLEXAR ™PX3236 ™ | LyondellBasell |
| AD2 | BYNEL ™39E660 ™ | DuPont |
| EV1 | ESCORENE ™ LD318.92 ™ | ExxonMobil |
| OB1 | SOARNOL ™ ET3803 ™ | Nippon Gohsei |
| PE1 | AFFINITY ™ PL 1888G ™ | Dow |
| PE2 | PETROTHENE ™ NA 345-013 ™ | LyondellBasell |
| PE3 | PE ™1042cs15 ™ | Flint Hills |
| PE4 | — | — |
| PE5 | EXCEED ™ 3512CB ™ | ExxonMobil |
| PE6 | — | — |

AB1 is a masterbatch having about 81% linear low density polyethylene, and about 19% of an antiblocking agent (diatomaceous earth).

AD1 is a maleic anhydride modified LLDPE that acts as a polymeric adhesive (tie layer material).

AD2 is a maleic anhydride modified EVA that acts as a polymeric adhesive (tie layer material).

EV1 is an ethylene/vinyl acetate copolymer with a vinyl acetate content of less than 10% by weight of the copolymer.

OB1 is EVOH with about 38 mole % ethylene.

PE1 is a branched, single-site catalyzed ethylene/octene copolymer with a density of about 0.9035 grams/cubic centimeter.

PE2 is LDPE.

PE3 is LDPE.

PE4 is a dry/pellet blend of 65% AD2 and 35% PE3.

PE5 is a linear, single-site catalyzed ethylene/hexene copolymer with a density of about 0.9120 grams/cubic centimeter.

PE6 is a blend of between 0.01% and 100%, by weight of the total composition, PE5, and between 100% and 0.01%, by weight of the total composition, EV1.

First and second side panels 12 and 14, and first and second gussets 19 and 20 respectively each comprise H7530B, a laminate having the construction:

| | | |
|---|---|---|
| chemically treated PET | polyurethane adhesive | coextruded barrier film |

where the PET is a biaxially oriented polyester film, and the coextruded barrier film has the construction:

| Layer 1 | Layer 2 | Layer 3 | Layer 4 | Layer 5 | Layer 6 | Layer 7 |
|---|---|---|---|---|---|---|
| PE1 | EV1 | AD1 | OB1 | AD1 | EV1 | 76% PE2 + 20% PE4 + 4% AB1 |
| 0.63 | 0.33 | 0.19 | 0.23 | 0.19 | 0.33 | 0.63 |

The overall thickness of the coextruded barrier film is about 2.50 mils. Layer gauges in mils for each layer are indicated below each layer. Layer 7 is the layer of the barrier film adhered, by the adhesive, to the PET film. Layer 1 is the heat sealant layer of the film, and the EAO (PE1) of layer 1 forms the inner or sealant surface of the package, facing the contained product, and the PET forms the outer or skin surface of the package. The thickness of the PET film is about 0.48 mils. The overall thickness of the laminate is about 3.0 mils.

Alternatives to the composition of layer 7 include various combinations of materials, including:

96% PE2+4% AB1.

100% PE2.

76% PE2+20% PE6+4% AB1.

The interlocking strips 10 and 13 of the package are in this example strips having self-mating elements derived from the VECTOR™ closure system available from ITW.

Before the package is made, strips 10 and 13 are anchored to the H7530B web (specifically, to layer 1 of the coextruded barrier film of the H7530B laminate) while the latter is in a lay-flat condition. A die cut is made in the web by a $CO_2$ laser prior to applying the strips to the web; the die cut defining a die cut segment is positioned so as to result in the package as shown in FIG. 1.

Example 2

Figure 12:
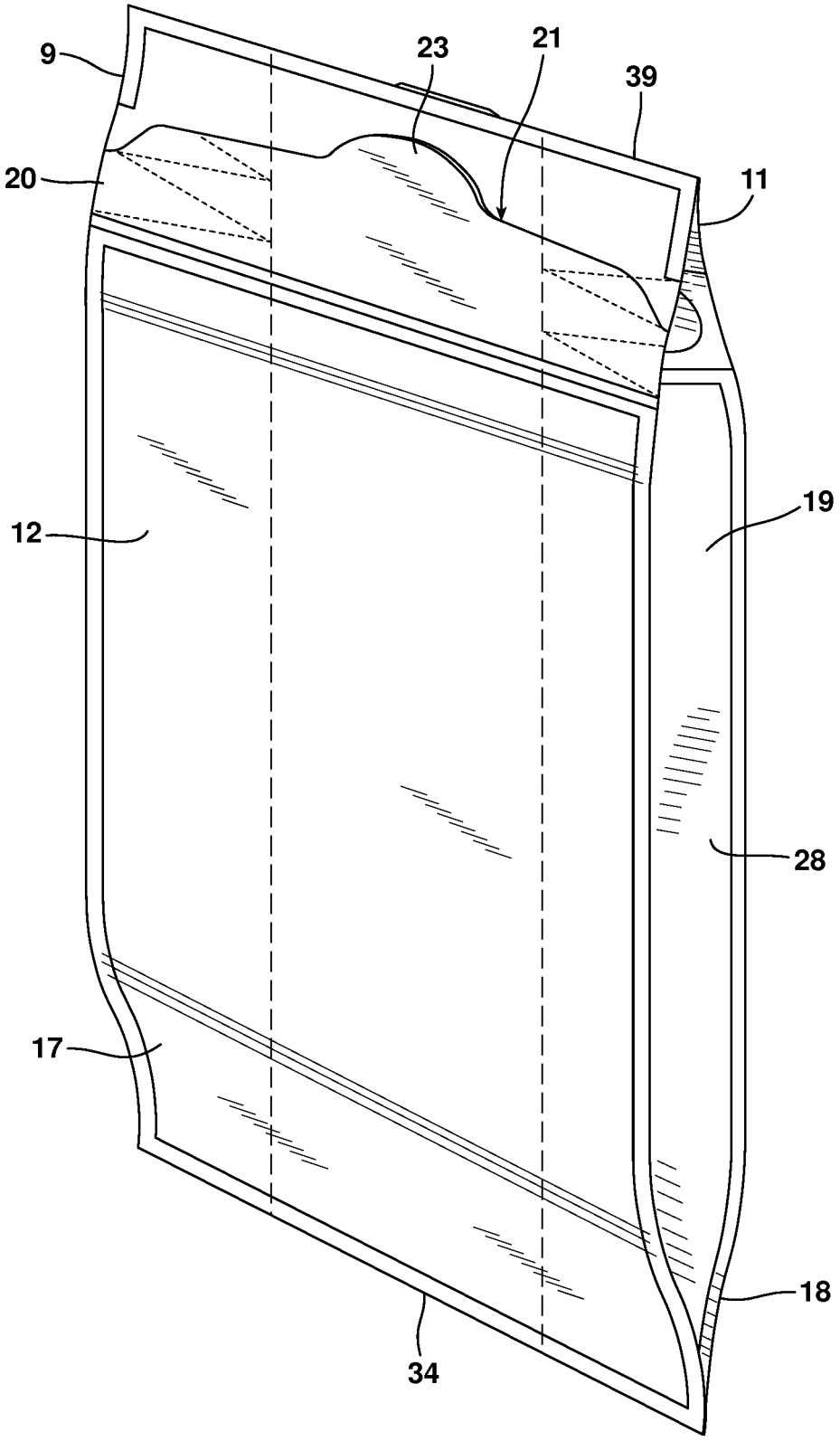
FIG. 12 is a perspective view of a package according to another embodiment.
Figure 13:
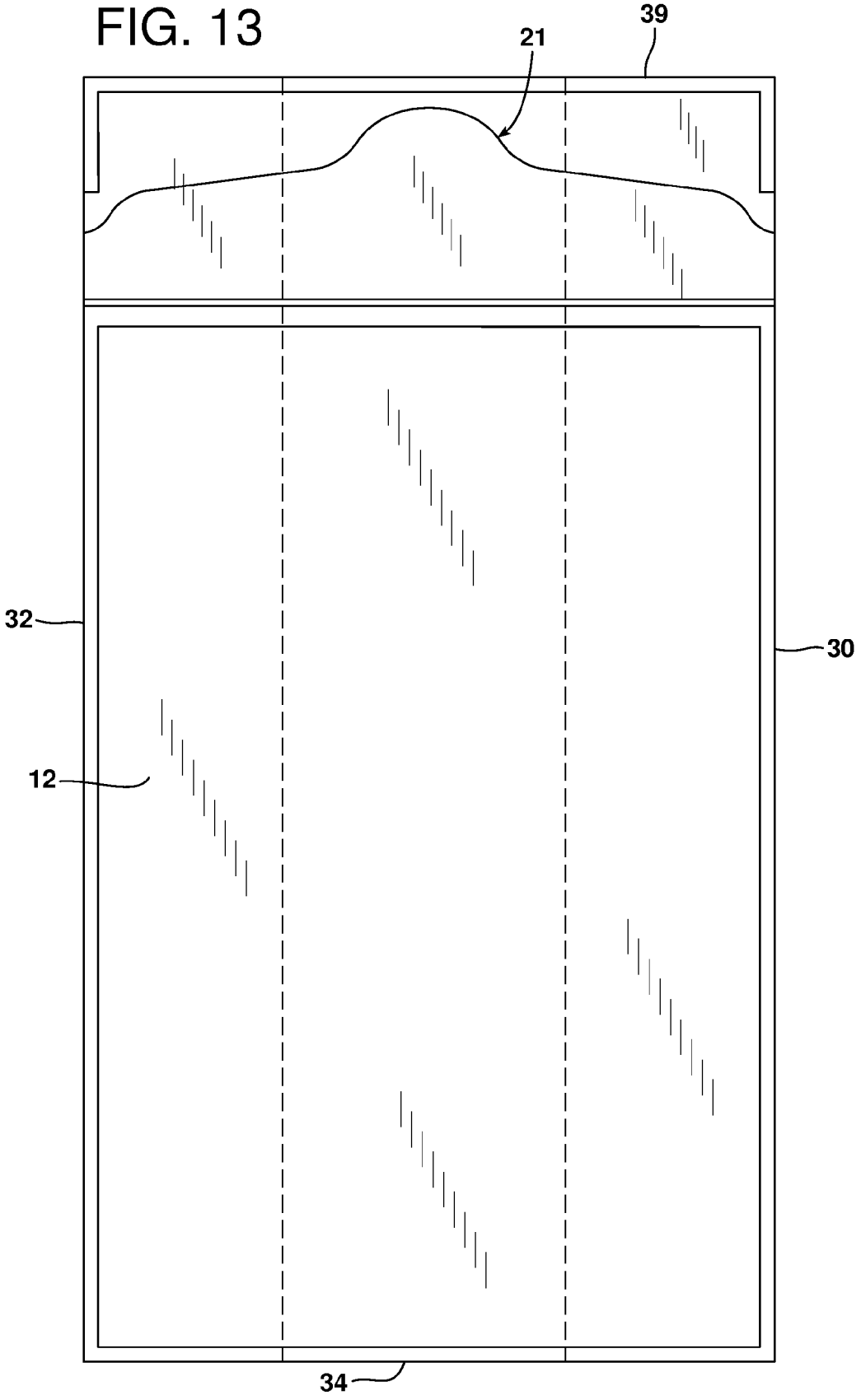
FIG. 13 is a front elevational view of the package of FIG. 12.
Figure 14:
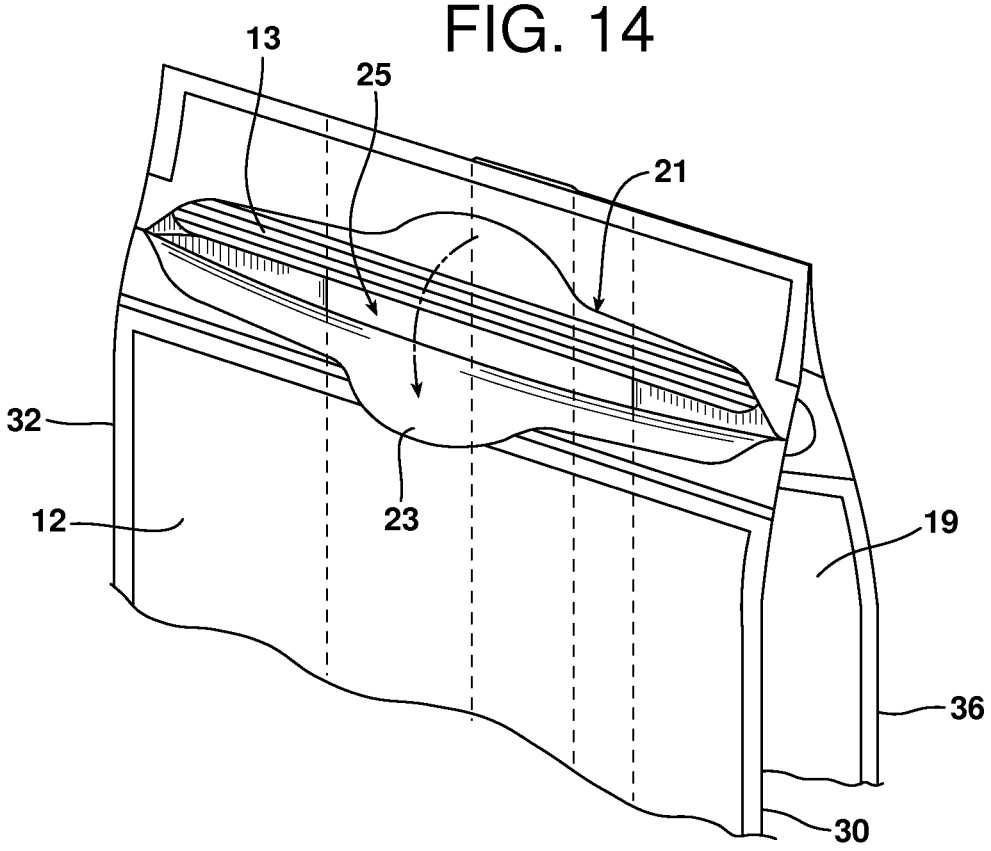
FIG. 14 is a perspective view of a portion of the package of FIG. 12 during an opening sequence.
Figure 15:
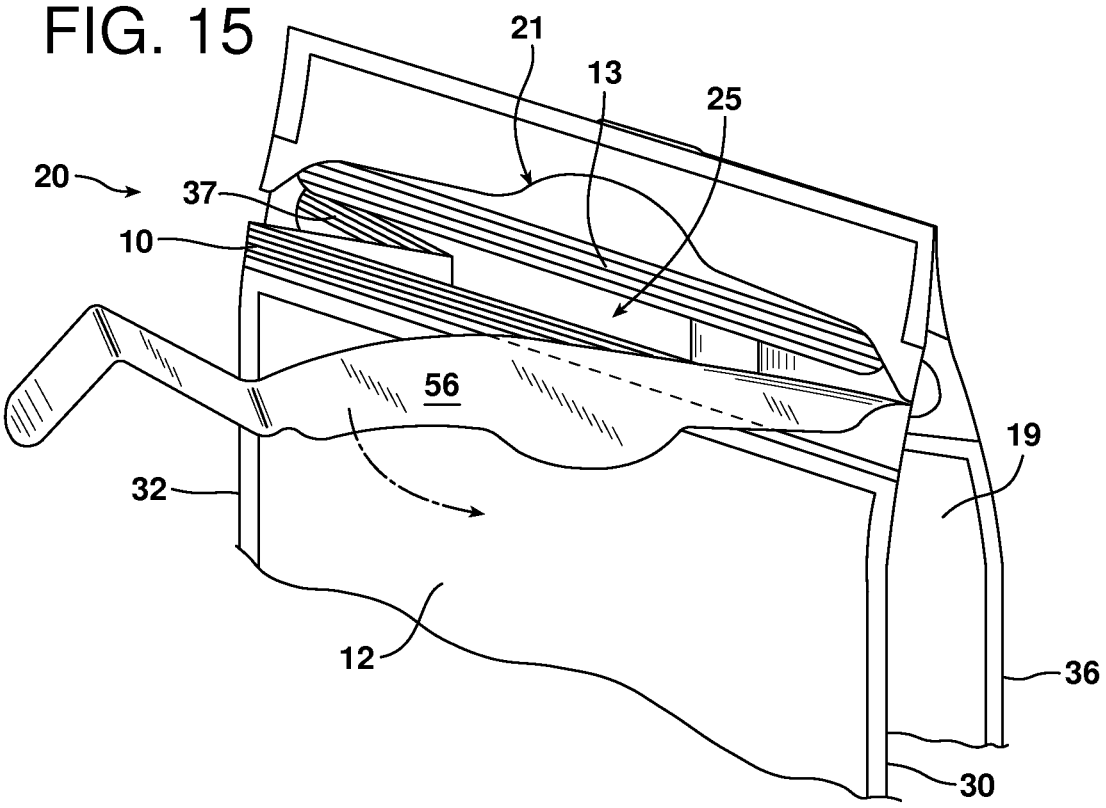
FIG. 15 is a perspective view of the package of FIG. 14 later in the opening sequence.
Figure 16:
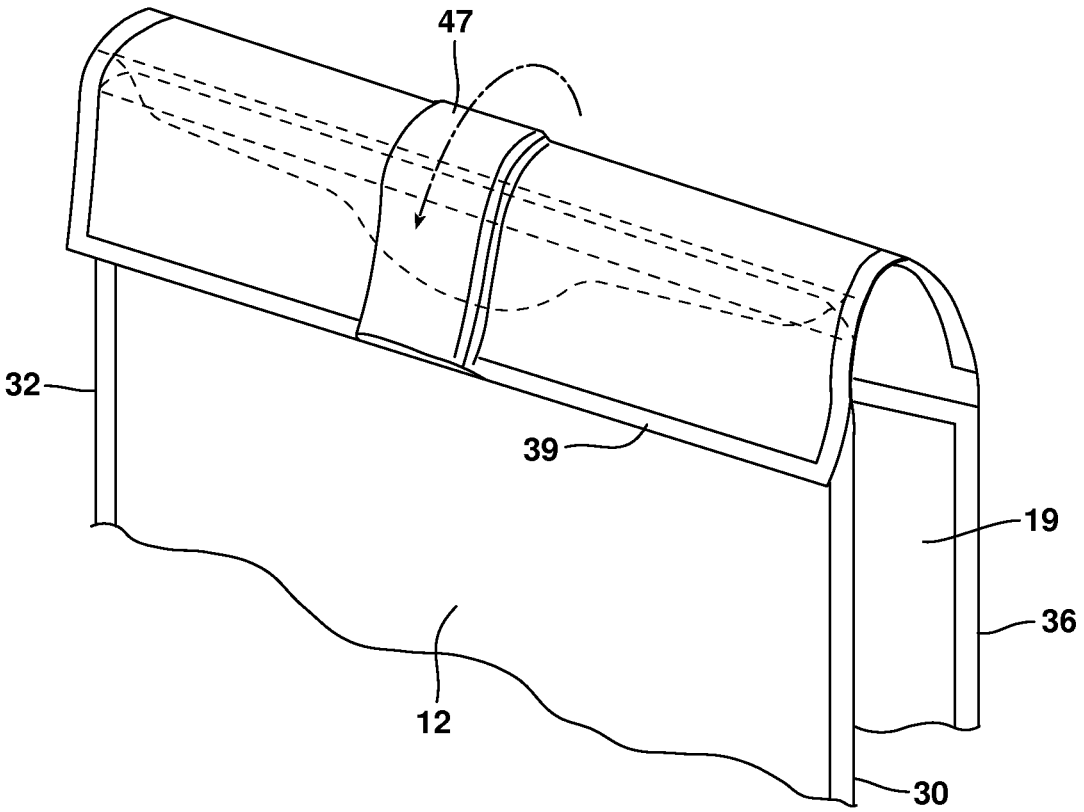
FIG. 16 is a perspective view of a portion of the package of FIG. 15 after it has been reclosed.

A package like that of Example 1 is made in accordance with the embodiment illustrated in FIG. 12 and described herein, in a vertical form/fill/seal system.

Example 3

A package like that of Example 1 is made in accordance with the embodiment illustrated in FIG. 1 and described herein, in a continuous horizontal packaging system.

Example 4

A package like that of Example 1 is made in accordance with the embodiment illustrated in FIG. 12 and described herein, in a continuous horizontal packaging system.

For any of the disclosed aspects and embodiments of the invention, the second interlocking strip can be anchored to the inner surface of either or both of the first or second side panel. Anchoring of both the first and second strips to the first side panel may be easier than anchoring the first strip to the first side panel, and the second strip to the second side panel, but the contents of the package could in some instances be trapped in the region between the second strip and the first end of the package. Anchoring the first strip to the first side panel, and the second strip to the second side panel would avoid this trapping issue, but may reduce to some extent the internal volume of the package available for holding product.

All parts and percentages are by weight, unless otherwise indicated or well understood in the art.

Terms referring to polymers, such as polyester, polyamide, and polyolefin, refer herein to both homopolymers and copolymers thereof, unless otherwise specified.

In the drawings, the flow of materials is in the direction of the arrows.

The drawings herein are not necessarily to scale, and certain features of the invention may be graphically exaggerated for clarity.

Both the web or webs used in the manufacture of the package according to the invention, and the interlocking strips, can be made by any suitable process, including coextrusion, extrusion coating, extrusion lamination, and conventional lamination using polyurethane or other adhesives. Extrusion can be done in annular or flat dies. The extrudate can be hot blown or cast, and optionally solid-state oriented as desired. Chemical or electronic crosslinking of one or more layers of the webs can be done. Both web and strips can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics. Printed indicia can be in the form of a message e.g. "easy open", "open here", etc. This can be printed in scattered process (i.e. registration is not required) on or near the first end of the package, and surface printed or reverse printed.

In some embodiments, it may be beneficial to adhere the strips to the lay-flat web prior to processing on equipment, or at the time, before processing, when the strips are disposed on the web. Any suitable means, such as permanent adhesive or heat sealing, can be used to seal the strips to the web to ensure that the strips maintain their position on the web during processing. In some embodiments, the strips are anchored to the web at the interface between the web and the surface of the strips comprising a sealant layer that provides a relatively strong seal. The strips can be e.g. sealed to the web by a suitable device (not shown) such as a heat sealer, disposed below the web while the web is in its lay-flat condition.

In the embodiments disclosed herein, the first end of the package can be sealed, typically where two webs are used to make the package. Alternatively, the first end of the package can be a fold, e.g. where a single web of material is used to make the package.

Although the first and second side panels are shown in various embodiments as having the same length, the second side panel can in some embodiments be longer than the first side panel, i.e. the first end of the second side panel can extend beyond the first end of the first side panel, or vice versa. The extended portion can e.g. accommodate a hang tab with a hole therein, or function as a fold-over flap for reclosing the package after opening.

In describing a panel, strip or the like being "sealed" to another panel, strip, or the like, sealing is done by conventional means as described, and typically occurs in seal widths consistent with industry practice for packaging.

Packages of the various embodiments of the invention disclosed herein can optionally be vacuumized or gas flushed by otherwise conventional means. A package in accordance with the invention can contain a modified atmosphere.

STATEMENT OF EMBODIMENTS OF THE INVENTION

The present application is directed in various embodiments to the subject matter described in the following paragraphs. These are optional embodiments of any of the first, second, third, or any subsequent aspects of the invention as described hereinabove in the Summary of the Invention, and for each aspect these features can be taken alone or in any suitable combination of these features:

a) at least one of the first and second interlocking strips comprises a skirt segment having a first and second surface, a first and second side edge, and a first and second end.

b) at least a portion of at least one of the first and second surfaces of the skirt segment of the first and/or second interlocking strip comprises a relatively strong sealant.

c) at least a portion of at least one of the first and second surfaces of the skirt segment of the first and/or second interlocking strip comprises an easy-open sealant.

d) the second surface of a first skirt segment of the first or second interlocking strip is anchored to the inner surface of the first side panel with a relatively strong seal.

e) the first end of the first and second side panels, and the first end of the first and second gussets, are joined together with a seal.

f) the first end of the first and second side panels, and the first end of the first and second gussets, are joined together with a fold.

g) the second end of the first and second side panels, and the second end of the first and second gussets, are joined together with a seal.

h) the second end of the first and second side panels, and the second end of the first and second gussets, are joined together with a fold.

i) the die cut segment is underlain by substantially the entirety of the interlocking surfaces of the first and second portions of the first interlocking strip, and the second. interlocking strip.

j) the die cut segment is underlain by substantially the entirety of the interlocking surfaces of the first, second, and third portions of the first interlocking strip, and the second. interlocking strip.

k) the package is absent a discrete thread or tear strip.

l) the die cut segment includes a first component wherein the die cut extends entirely through the first side panel, and a second component wherein the die cut extends partially through the first side panel and the first gusset.

m) the die cut segment includes a first component wherein the die cut extends entirely through the first side panel, and a second component wherein the die cut extends partially through the first side panel and the second gusset.

n) the die cut segment includes a first component wherein the die cut extends entirely through the first side panel, and a second component wherein the die cut extends partially through the first side panel and the first and second gussets.

o) an easy-open seal seals a skirt of the first interlocking strip to the inner surface of the first side panel and the inner surface of the first gusset.

p) an easy-open seal seals a skirt of the first interlocking strip to the inner surface of the first side panel and the inner surface of the first and second gussets.

q) an easy-open seal seals a skirt of the second interlocking strip to the inner surface of the second side panel.

r) the first and second interlocking strips each comprise hook-and-loop fasteners.

s) the first and second interlocking strips each comprise self-interlocking male fasteners.

t) the first and second interlocking strips each comprise self-mating fasteners.

u) the package can be produced using two reels, each carrying and dispensing an interlocking strip.

v) the first and second interlocking strips are initially made and anchored to the package in one piece, with a connecting piece between them, such that when the package is opened, the connecting piece is torn, providing access to the contents of the package.

w) the interlocking surfaces of strips 10 and 13 are spaced apart from the first and second ends of the package.

x) first and second interlocking strips 10 and 13 are positioned substantially parallel to one another.

y) the interlocking surfaces of strips 10 and 13 are spaced apart from each other sufficiently to enable the package, after opening, to be folded such that the interlocking surface of second strip 13 can be brought into engagement with the interlocking surface of the first portion of first strip 10 to reclose the package.

z) when the die cut segment is displaced, and the package is opened, the product can be accessed between the first and second interlocking strips, and the interlocking surface of each of the first and second interlocking strips is at least partially exposed.

aa) when the die cut segment is removed, the package can thereafter be reclosed by engaging the interlocking surface of the second portion of the first interlocking strip with itself, folding the package, and engaging the interlocking surface of the second interlocking strip with the interlocking surface of the first portion of the first interlocking strip.

bb) the interlocking surfaces of the first and second interlocking strips are not exposed until the package is initially opened.

cc) the interlocking surfaces of the second interlocking strip, and the first portion of the first interlocking strip, are not engaged until the package is initially opened and then reclosed.

dd) the interlocking surface of the first interlocking strip is disposed farther from the first end of the package than the interlocking surface of the second interlocking strip.

ee) the first interlocking strip is longer than the second interlocking strip.

ff) the package comprises a fin seal that functions as a rib seal.

gg) the die cut segment is a closed loop die cut segment.

What is claimed is:

1. An easy-open and reclosable gusseted package, enclosing a product, comprising a pouch comprising:

a) a first and second side panel each comprising an outer and inner surface, a first and second side edge, and a first and second end;

b) a first pouch end and a second pouch end;

c) a first and second gusset each comprising an outer and inner surface, a first and second side edge, and a first and second end, the first gusset connecting the first and second side panels at a first side of the pouch, and the second gusset connecting the first and second side panels at a second side of the pouch;

d) a reclosure mechanism comprising (i) a first interlocking strip comprising (a) a first and second side edge, (b) a first and second end, and (c) an interlocking segment having a base surface and an interlocking surface, wherein a first portion of the first interlocking strip is anchored to the inner surface of the first side panel such that part of the interlocking surface faces the inner surface of the first side panel, and a second portion of the first interlocking strip is anchored to the inner surface of the first gusset, and (ii) a second interlocking strip comprising a first and second side edge, a first and second end, and an interlocking segment having a base surface and an interlocking surface, the second interlocking strip anchored to the inner surface of at least one of the first and second side panels, such that the interlocking surface faces the inner surface of the first side panel; and e) a die cut disposed in the first side panel and the first gusset, the die cut defining a die cut segment that is spaced from the first and second ends of the package.

2. The package of claim 1 wherein the package is configured such that (a) before the package is initially opened, the interlocking surfaces of the first and second interlocking strips are not exposed;

(b) the interlocking surfaces of the second interlocking strip, and the first portion of the first interlocking strip, are not engaged until the package is initially opened and then reclosed;

(c) the interlocking surface of the first interlocking strip is farther from the first end of the package than the interlocking surface of the second interlocking strip; and (d) the first interlocking strip is longer than the second interlocking strip.

3. The package of claim 1 wherein at least one of the first and second interlocking strips comprises a skirt segment having a first and second surface, a first and second side edge, and a first and second end.

4. The package of claim 3 wherein at least a portion of at least one of the first and second surfaces of the skirt segment comprises an easy-open sealant.

5. The package of claim 1 wherein the closed loop die cut segment includes a first component wherein the die cut extends entirely through the first side panel, and a second component wherein the die cut extends partially through the first side panel and the first gusset.

6. The package of claim 1 wherein the closed loop die cut is disposed in the second gusset, and the first interlocking strip comprises a third portion anchored to the inner surface of the second gusset.

7. The package of claim 6 wherein when the package is opened, the package can thereafter be reclosed by engaging the interlocking surface of the third portion of the first interlocking strip with itself.

8. A method of making an easy-open and reclosable gusseted package in a vertical form/fill/seal process comprising:

a) providing a lay-flat web, the lay-flat web comprising a first and second surface, and a die cut;

b) providing a reclosure mechanism comprising a first and second interlocking strip each comprising a first and second side edge, a first and second end, and an interlocking segment having a base surface and an interlocking surface;

c) advancing the lay-flat web with the reclosure mechanism over a forming device to convert the lay-flat web to a folded web having an interior surface;

d) longitudinally sealing the folded web to make a longitudinal seal;

e) forming a first and second gusset in the folded web;

f) transversely sealing the folded web to produce a first transverse seal to define a first pouch, wherein the first transverse seal is a bottom transverse seal of the first pouch;

g) putting a product in the first pouch;

h) advancing the folded web, with the first pouch, downward a predetermined di stance;

i) transversely sealing the first pouch to produce a top transverse seal in the first pouch, and a bottom transverse seal in a second pouch, the second pouch disposed above the first pouch; and j) transversely cutting the folded web to separate the first pouch from the second pouch to make a package, the package comprising (i) a first and second side panel each comprising an outer and inner surface, a first and second side edge, and a first and second end, (ii) a first pouch end and a second pouch end, (iii) the first and second gusset each comprising an outer and inner surface, a first and second side edge, and a first and second end, the first gusset connecting the first and second side panels at a first side of the pouch, and the second gusset connecting the first and second side panels at a second side of the pouch, and (iv) a first portion of the first interlocking strip anchored to the inner surface of the first side panel such that a part of the interlocking surface of the first interlocking strip faces the inner surface of the first side panel, and a second portion of the first interlocking strip anchored to the inner surface of the first gusset and the second interlocking strip anchored to the inner surface of at least one of the first and second side panels such that the interlocking surface of the second interlocking strip faces the inner surface of the first side panel;

wherein each of the first and second interlocking strips is either pre-anchored to the lay-flat web, or is anchored to the lay-flat web or the folded web at any time before or during the step of making the longitudinal seal in the folded web; and wherein the die cut is disposed in the first side panel and the first gusset, the die cut defining a die cut segment that is spaced from the first and second ends of the package.

9. The method of claim 8 wherein the package is configured such that (a) the interlocking surfaces of the first and second interlocking strips are not exposed until the package is initially opened;

(b) the interlocking surfaces of the second interlocking strip, and the first portion of the first interlocking strip, are not engaged until the package is initially opened and then reclosed;

(c) the interlocking surface of the first interlocking strip is farther from the first end of the package than the interlocking surface of the second interlocking strip; and (d) the first interlocking strip is longer than the second interlocking strip.

10. The method of claim 8 wherein at least one of the first and second interlocking strips comprises a skirt segment having a first and second surface, a first and second side edge, and a first and second end.

11. The method of claim 10 wherein at least a portion of at least one of the first and second surfaces of the skirt segment comprises an easy-open sealant.

12. The method of claim 8 wherein the die cut is disposed in the second gusset, and the first interlocking strip comprises a third portion anchored to the inner surface of the second gusset.

13. The method of claim 12 wherein when the package is opened, the package can thereafter be reclosed by engaging the interlocking surface of the third portion of the first interlocking strip with itself.

14. A method of making an easy-open and reclosable gusseted package in a continuous horizontal packaging process comprising:

a) providing a lay-flat web, the lay-flat web comprising a first and second surface, and a die cut;

b) providing a reclosure mechanism comprising a first and second interlocking strip each comprising a first and second side edge, a first and second end, and an interlocking segment having a base surface and an interlocking surface;

c) advancing the lay-flat web with the reclosure mechanism to a forming device to convert the lay-flat web into a folded web having an interior surface;

d) advancing a product to the forming device such that the folded web envelopes the product;

e) longitudinally sealing the folded web to make a longitudinal seal;

f) forming a first and second gusset in the folded web;

g) transversely sealing the folded web, with the product therein, to produce a leading transverse seal to define a first pouch;

h) advancing the folded web, with the leading transverse seal, forward a predetermined distance;

i) transversely sealing the folded web to produce a trailing transverse seal in the first pouch, and a leading transverse seal in a second pouch, the second pouch disposed upstream of the first pouch; and j) cutting the folded web to separate the first pouch from the second pouch to form an individual package comprising (i) a first and second side panel each comprising an outer and inner surface, a first and second side edge, and a first and second end, (ii) a first pouch end and a second pouch end, (iii) the first and second gusset each comprising an outer and inner surface, a first and second side edge, and a first and second end, the first gusset connecting the first and second side panels at a first side of the pouch, and (iv) the second gusset connecting the first and second side panels at a second side of the pouch, and (iv) a first portion of the first interlocking strip anchored to the inner surface of the first side panel such that a part of the interlocking surface of the first interlocking strip faces the inner surface of the first side panel, and a second portion of the first interlocking strip anchored to the inner surface of the first gusset, and the second interlocking strip anchored to the inner surface of at least one of the first and second side panels such that the interlocking surface of the second interlocking strip faces the inner surface of the first side panel;

wherein each of the first and second interlocking strips is either pre-anchored to the lay-flat web, or is anchored to the lay-flat web or the folded web at any time before or during the step of making the longitudinal seal in the folded web; and wherein the die cut is disposed in the first side panel and the first gusset, the die cut defining a die cut segment that is spaced from the first and second ends of the package.

15. The method of claim 14 wherein the package is configured such that (a) the interlocking surfaces of the first and second interlocking strips are not exposed until the package is initially opened;

(b) the interlocking surfaces of the second interlocking strip, and the first portion of the first interlocking strip, are not engaged until the package is initially opened and then reclosed;

(c) the interlocking surface of the first interlocking strip is farther from the first end of the package than the interlocking surface of the second interlocking strip; and (d) the first interlocking strip is longer than the second interlocking strip.

16. The method of claim 14 wherein at least one of the first and second interlocking strips comprises a skirt segment having a first and second surface, a first and second side edge, and a first and second end.

17. The method of claim 16 wherein at least a portion of at least one of the first and second surfaces of the skirt segment comprises an easy-open sealant.

18. The method of claim 17 wherein the die cut segment includes a first component wherein the die cut segment extends entirely through the first side panel, and a second component wherein the die cut extends partially through the first side panel and the first gusset.

19. The method of claim 14 wherein the die cut segment includes a first component wherein the die cut extends entirely through the first side panel, and a second component wherein the die cut extends partially through the first side panel and the first gusset.

20. The method of claim 14 wherein the die cut is disposed in the second gusset, and the first interlocking strip comprises a third portion anchored to the inner surface of the second gusset.

21. The method of claim 20 wherein when the package is opened, the package can thereafter be reclosed by engaging the interlocking surface of the third portion of the first interlocking strip with itself.

* * * * *